US010713910B2

(12) United States Patent
Taylor et al.

(10) Patent No.: US 10,713,910 B2
(45) Date of Patent: Jul. 14, 2020

(54) FLEXIBLE SENSOR FOR A PORTABLE ELECTRONIC DEVICE

(71) Applicant: InVue Security Products Inc., Charlotte, NC (US)

(72) Inventors: Gary A. Taylor, Fort Mill, SC (US); David N. Berglund, Indian Trail, NC (US); Hrishikesh P. Gogate, Charlotte, NC (US); Jonathon D. Phillips, Fort Mill, SC (US); Jeffrey A. Grant, Charlotte, NC (US)

(73) Assignee: InVue Security Products Inc., Charlotte, NC (US)

( * ) Notice: Subject to any disclaimer, the term of this patent is extended or adjusted under 35 U.S.C. 154(b) by 325 days.

(21) Appl. No.: 15/031,047

(22) PCT Filed: Oct. 29, 2014

(86) PCT No.: PCT/US2014/062769
§ 371 (c)(1),
(2) Date: Apr. 21, 2016

(87) PCT Pub. No.: WO2015/066107
PCT Pub. Date: May 7, 2015

(65) Prior Publication Data

US 2016/0253881 A1 Sep. 1, 2016

Related U.S. Application Data

(60) Provisional application No. 61/897,538, filed on Oct. 30, 2013, provisional application No. 61/897,706,
(Continued)

(51) Int. Cl.
*G08B 13/14* (2006.01)
*G08B 29/18* (2006.01)

(52) U.S. Cl.
CPC ..... *G08B 13/1454* (2013.01); *G08B 13/1445* (2013.01); *G08B 13/1463* (2013.01); *G08B 29/181* (2013.01)

(58) Field of Classification Search
CPC ..... G08B 13/1454; G08B 13/1445; G08B 13/1463; G08B 29/181
See application file for complete search history.

(56) References Cited

U.S. PATENT DOCUMENTS 4,000,488 A 12/1976 Ephraim
5,172,098 A 12/1992 Leyden et al.
(Continued)

FOREIGN PATENT DOCUMENTS

EP 260330 A1 3/1988
FR 2405526 A1 5/1979
(Continued)

OTHER PUBLICATIONS

Extended European Search Report from corresponding EP Application No. 14858076.4, dated Oct. 7, 2016, Munich, Germany (9 pages).
(Continued)

*Primary Examiner* — Curtis B Odom
(74) *Attorney, Agent, or Firm* — InVue Security Products Inc.

(57) ABSTRACT

A merchandise display security device for a portable electronic device having a removable component is provided. The merchandise display security device includes a sensor configured to be secured to the portable electronic device and monitoring electronics configured to detect unauthorized removal of the sensor from the portable electronic device. The merchandise display security device also includes a secondary sensor in electrical communication with the monitoring electronics, wherein the secondary
(Continued)

sensor includes a flexible component configured to be positioned between the portable electronic device and the removable component. The monitoring electronics is configured to detect unauthorized removal of the removable component in response to movement of the flexible component.

20 Claims, 18 Drawing Sheets

Related U.S. Application Data filed on Oct. 30, 2013, provisional application No. 61/915,197, filed on Dec. 12, 2013, provisional application No. 61/930,589, filed on Jan. 23, 2014, provisional application No. 61/989,647, filed on May 7, 2014.

(56) References Cited

U.S. PATENT DOCUMENTS

| | | | | |
|---|---|---|---|---|
| 5,521,336 | A | 5/1996 | Buchanan et al. | |
| 5,535,274 | A | 7/1996 | Braitberg et al. | |
| 5,574,430 | A | 11/1996 | Ott et al. | |
| 5,767,772 | A | 6/1998 | Lemaire et al. | |
| 5,861,807 | A * | 1/1999 | Leyden | G08B 13/1463 340/568.2 |
| 5,936,525 | A | 8/1999 | Leyden et al. | |
| 6,050,622 | A | 4/2000 | Gustafson | |
| 6,380,855 | B1 | 4/2002 | Ott | |
| 6,384,339 | B1 | 5/2002 | Neuman | |
| 7,084,762 | B2 | 8/2006 | Pedrazzini et al. | |
| 7,168,275 | B2 | 1/2007 | Fawcett et al. | |
| 7,209,038 | B1 | 4/2007 | Deconinck et al. | |
| 7,327,276 | B1 | 2/2008 | Deconinck et al. | |
| 7,593,142 | B2 | 9/2009 | Marszalek et al. | |
| 7,710,266 | B2 | 5/2010 | Belden, Jr. et al. | |
| 7,714,722 | B2 | 5/2010 | Marszalek et al. | |
| 8,274,391 | B2 | 9/2012 | Yang | |
| 8,305,219 | B2 | 11/2012 | Yang | |
| 8,368,542 | B2 | 2/2013 | Yang | |
| 8,368,543 | B2 | 2/2013 | Yang | |
| 8,373,565 | B2 | 2/2013 | Yang | |
| 8,564,438 | B2 | 10/2013 | Fawcett et al. | |
| 8,872,660 | B2 | 10/2014 | Yunker et al. | |
| 9,097,380 | B2 | 8/2015 | Wheeler | |
| 9,373,236 | B2 | 6/2016 | Oehl et al. | |
| 9,474,392 | B2 | 10/2016 | Howarth et al. | |
| 2005/0001485 | A1 | 1/2005 | Pail | |
| 2006/0220855 | A1 | 10/2006 | Hartmann et al. | |
| 2007/0152819 | A1 | 7/2007 | Marszalek et al. | |
| 2007/0171061 | A1 | 7/2007 | Belden et al. | |
| 2008/0037979 | A1 | 2/2008 | Guthrie et al. | |
| 2011/0298627 | A1 | 12/2011 | Wheeler | |
| 2011/0309934 | A1 | 12/2011 | Henson et al. | |
| 2012/0105230 | A1 | 5/2012 | Bockstoce et al. | |
| 2012/0192600 | A1 * | 8/2012 | Johnston | A47F 7/024 70/58 |
| 2012/0238845 | A1 | 9/2012 | Yang | |
| 2013/0194096 | A1 | 8/2013 | Belden, Jr. et al. | |
| 2013/0196530 | A1 | 8/2013 | Cheatham et al. | |
| 2014/0077953 | A1 | 3/2014 | Yang | |
| 2014/0306014 | A1 | 10/2014 | Salle et al. | |
| 2015/0287299 | A1 | 10/2015 | Eckert et al. | |

FOREIGN PATENT DOCUMENTS

| | | |
|---|---|---|
| GB | 2291733 | 9/1996 |
| GB | 2347773 B | 9/2003 |
| JP | 2000339556 | 12/2000 |
| JP | 2013003937 | 1/2013 |
| WO | 9607996 A2 | 3/1996 |
| WO | 2008088699 A2 | 7/2008 |
| WO | 2011127334 A2 | 10/2011 |
| WO | 2013030813 A2 | 3/2013 |
| WO | 2013081469 A1 | 6/2013 |

OTHER PUBLICATIONS

Extended European Search Report from related EP Application No. 14857081.5, dated Oct. 6, 2016, Munich, Germany (9 pages).

First Office Action from corresponding Chinese patent application No. 201480071206.1 dated May 10, 2017 (7 pages).

International Search Report and Written Opinion for related International Application No. PCT/US2014/062768, dated Mar. 23, 2015 (9 pages).

Lee W. Young, Notification of Transmittal of the International Search Report and the Written Opinion of the International Searching Authority, or the Declaration for International (PCT) Application No. PCT/US2014/062769, dated Apr. 7, 2015, 8 pages, Alexandria, Virginia.

Shopguard Online Store, Flexible Battery Sensor 8cm, 1 page, printed Feb. 28, 2014.

shopguard.com, Camera Solutions, EAS solutions for digital cameras and SLRs, 1 page, printed Feb. 28, 2014.

U.S. Appl. No. 15/031,095, filed Apr. 21, 2016.

* cited by examiner

FLEXIBLE SENSOR FOR A PORTABLE ELECTRONIC DEVICE

CROSS REFERENCE TO RELATED APPLICATIONS

This application claims the benefit to priority of U.S. Provisional Patent Application No. 61/897,538 filed on Oct. 30, 2013, U.S. Provisional Patent Application No. 61/897,706 filed on Oct. 30, 2013, and of U.S. Provisional Patent Application No. 61/930,589 filed on Jan. 23, 2014, U.S. Provisional Patent Application No. 61/915,197 filed on Dec. 12, 2013, and U.S. Provisional Patent Application No. 61/989,647 filed on May 7, 2014, the entire disclosures of which are incorporated herein by reference.

FIELD OF THE INVENTION

Embodiments of the present invention relate generally to merchandise display security systems and methods for displaying and protecting portable electronic items of merchandise against theft, such as cameras.

BACKGROUND OF THE INVENTION

It is common practice for retailers to display relatively expensive items of merchandise on a merchandise display security device, such as an alarming display stand. The security device displays an item of merchandise so that a potential purchaser can readily view and, in some instances, operate the item when making a decision whether to purchase the item. At the same time, the item of merchandise is usually physically secured on the security device so as to prevent, or at least deter, theft of the item. The merchandise display security device may also include an audible and/or visible alarm that is activated to alert store personnel in the event that a shoplifter attempts to separate the item of merchandise from the security device.

Retailers especially like to display cameras and the like on a merchandise display security device since a potential purchaser will typically desire to experience physical characteristics and operating features of the merchandise such as size, weight, balance, tactile comfort and the quality of the image seen through the viewfinder, as well as operation of the camera lens. In some cases, a camera lens is more valuable than the camera itself. Thus, it is desirable to prevent or deter theft or unauthorized removal of the camera lens.

BRIEF SUMMARY

Embodiments of the present invention are directed to merchandise display security devices. In one embodiment, a merchandise display security device for a portable electronic device having an internal power source is provided. The merchandise display security device comprises a sensor configured to be secured to the portable electronic device and to be in electrical communication with an external power source. The sensor is further configured to determine whether to transfer power to the internal power source. The merchandise display security device also includes a flexible circuit in electrical communication with the internal power source and the sensor. The flexible circuit is configured to transfer power provided to the sensor to the internal power source.

In another embodiment, a method for protecting a portable electronic device having an internal power source from theft is provided. The method comprises attaching a flexible circuit to the internal power source of the portable electronic device and securing a sensor to the portable electronic device such that the sensor is electrically connected to the flexible circuit and is configured to determine whether to transfer power to the internal power source. The method further includes connecting the sensor to an external power source such that power provided from the external power source is able to be transferred to the internal power source by the sensor and the flexible circuit.

In another embodiment, a merchandise display security device for a portable electronic device having a removable component is provided. The merchandise display security device comprises a sensor configured to be secured to the portable electronic device and monitoring electronics configured to detect unauthorized removal of the sensor from the portable electronic device. The merchandise display security device also includes a secondary sensor in electrical communication with the monitoring electronics, wherein the secondary sensor comprises a flexible component configured to be positioned between the portable electronic device and the removable component. The monitoring electronics is configured to detect unauthorized removal of the removable component in response to movement of the flexible component.

In an additional embodiment, a method for protecting a portable electronic device having a removable component from theft is provided. The method comprises securing a sensor to a portable electronic device having a removable component such that the sensor is in electrical communication with monitoring electronics for detecting unauthorized removal of the sensor from the portable electronic device. The method also includes positioning a flexible component of a secondary sensor between the portable electronic device and the removable component. The monitoring electronics is in electrical communication with the secondary sensor for detecting unauthorized removal of the removable component in response to movement of the flexible component.

DETAILED DESCRIPTION OF EMBODIMENTS OF THE INVENTION

Figure 1:
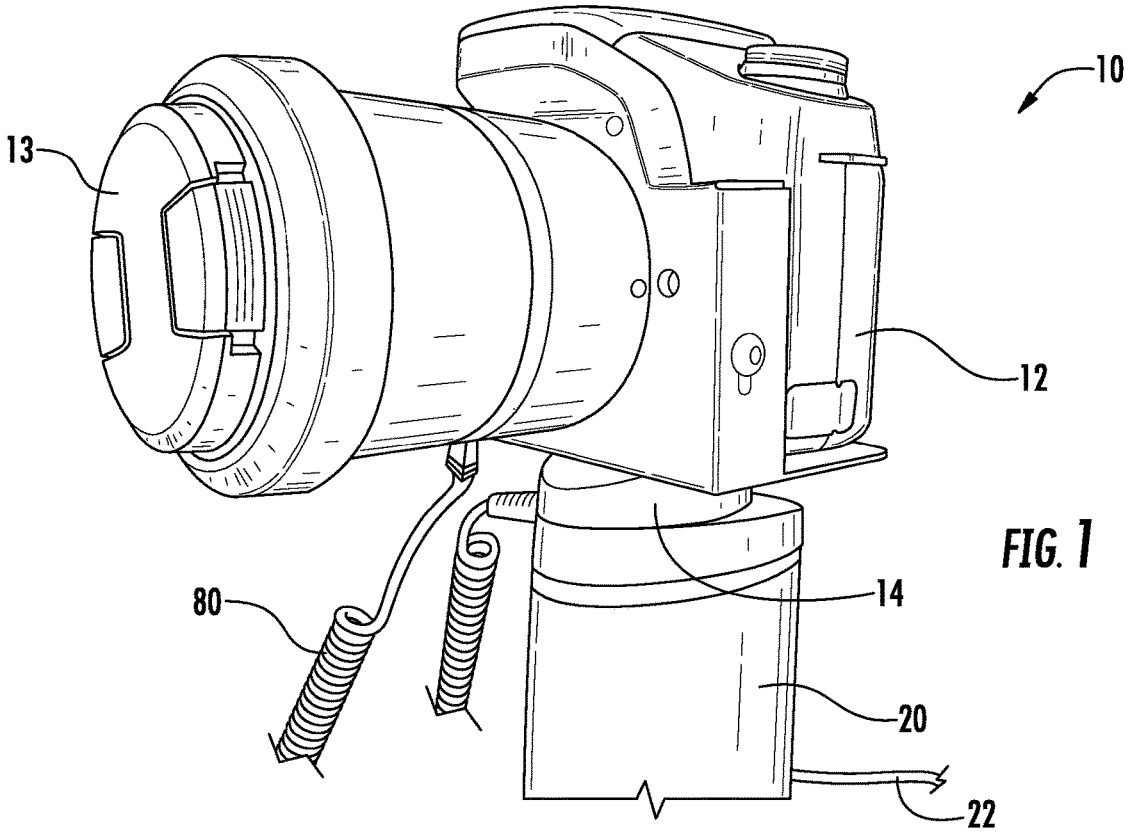
FIG. 1 is a perspective view of a merchandise display security device secured to a camera according to one embodiment of the present invention.

Referring now to the accompanying drawing figures wherein like reference numerals denote like elements throughout the various views, one or more embodiments of a merchandise display security device are shown. Merchandise display security devices suitable for use with the present invention include, but are not limited to, alarm modules and alarming display stands, such as the Series 940, 1000, and 2000 PODs available from InVue Security Products Inc. of Charlotte, N.C., USA. According to one embodiment, the merchandise display security device is similar to that disclosed in U.S. application Ser. No. 13/632,469 entitled Camera Sensor Having a Reversible Sensor Housing and Reversible Adapter, the contents of which are hereby incorporated by reference in its entirety. However, those of ordinary skill in the art will readily appreciate that camera sensors and sensors for other types of merchandise constructed in accordance with the present invention are useable with other merchandise display security devices and merchandise display systems. A merchandise display security device according to embodiments of the present invention is advantageously useable with devices and systems that require power to be supplied to an item of merchandise from an external power source, such as a direct current (DC) transformer in electrical communication with a source of alternating current (AC) electricity. In particular embodiments, the merchandise display security device is also useful for items of merchandise comprising an internal power source (e.g., a battery) that is rechargeable for allowing a customer to examine and experience the functionality of the item of merchandise.

Figure 2:
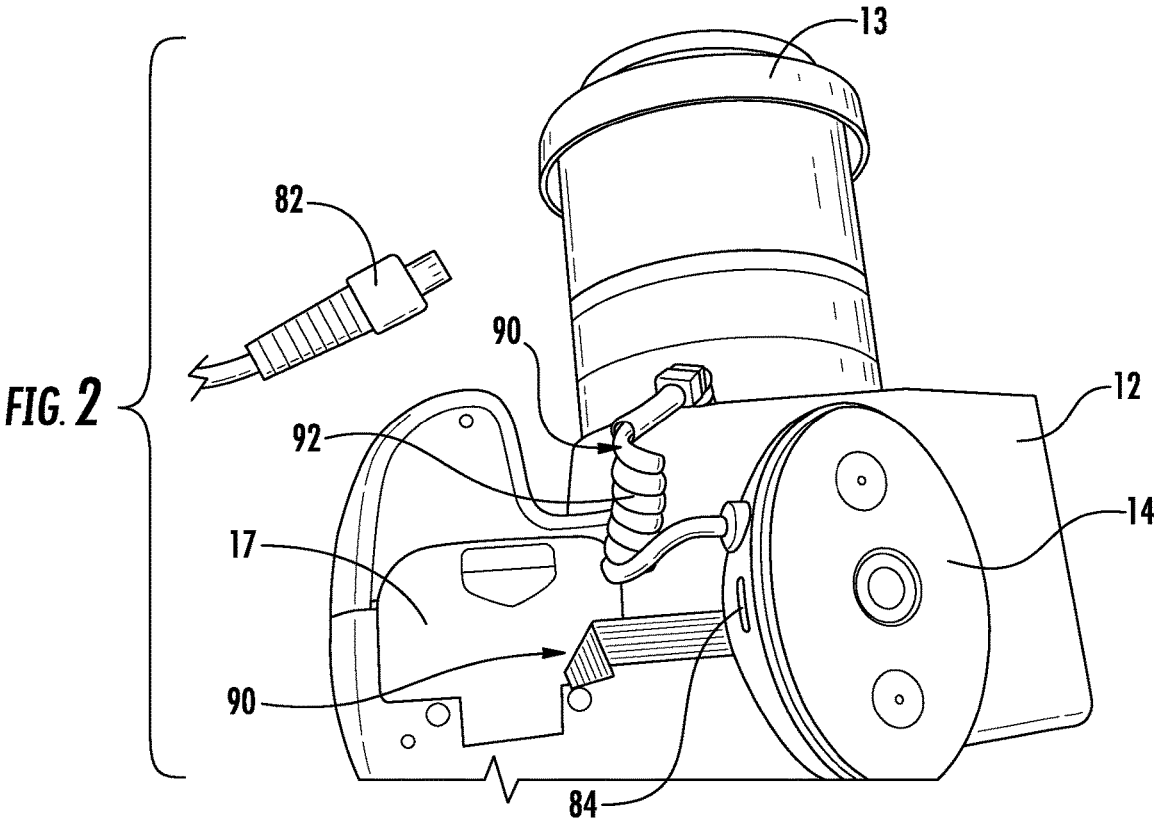
FIG. 2 is a bottom view of the merchandise display security device shown in FIG. 1.

FIGS. 1 and 2 show an embodiment of a merchandise display security device 10 including a sensor 14 configured to be secured to a camera 12. According to various embodiments, the merchandise display security device 10 is configured for use with various types of cameras 12 and other portable electronic items of merchandise including an internal power source 15, such as one or more rechargeable batteries. According to other embodiments, the merchandise display security device 10 is configured for use with various types of cameras and other portable electronic items of merchandise including a removable component, such as a removable lens. For example, the merchandise display security device 10 may be suitable for use with cameras and video recorders, such as handheld cameras, tripod mount cameras, single-lens reflex (SLR) cameras, digital single-lens reflex (DSLR) cameras, camcorders, and point-and-shoot cameras. Although the following discussion is made in the context of a merchandise display security device 10 for a camera 12, it is understood that the merchandise display security device is suitable for use with any number of portable electronic devices having an internal power source and/or one or more removable components, such as, for example, mobile phones, tablets, computers, etc.

FIGS. 1 and 2 show a merchandise display security device 10 including an embodiment of a sensor 14 configured for use with a camera 12 having a removable lens 13. The security device 10 may include a display stand 20 for removably supporting the sensor 14 thereon. The display stand 20 may have any desired size and configuration for receiving and supporting the sensor 14 thereon. In some embodiments, the sensor 14 and display stand 20 may be configured such that the sensor may be positioned on the display stand in one of a plurality of different display positions. The display stand 20 may include one or more magnets or magnetically attractable material that are complementary to one or more magnets or magnetically attractable material in or on the sensor 14 for facilitating alignment and securement when the sensor is supported on the display stand. Furthermore, the display stand 20 and the sensor 14 may each be provided with complementary external and/or internal geometry features for aligning the sensor relative to display stand in a predetermined desired orientation.

Display stand 20 may contain monitoring electronics that monitor the state of the sensor 14 for detecting whether the camera 12 is securely attached to the sensor. The display stand 20 may also contain an audible alarm and/or a visible alarm, such as a piezo and/or LED, that is activated when the monitoring electronics detects that the sensor 14 indicates an "unsecured" or "alarm" state. Moreover, display stand 20 may contain an internal power source (e.g., a battery) for providing power to the monitoring electronics and the sensor 14, or alternatively or additionally, may comprise a main power cord 22 that is electrically connected to an external power source, such as a direct current (DC) transformer and an alternating current (AC) electrical outlet.

In some embodiments, the monitoring electronics is configured to be armed and disarmed. For example, the monitoring electronics may be configured to communicate with a key for arming and disarming thereof. In one embodiment, the key is an electronic key. In other embodiments, the key is similar to that disclosed in U.S. Pat. No. 7,737,845 entitled Programmable Key for a Security System for Protecting Merchandise, the contents of which are incorporated by reference herein it its entirety.

In some embodiments, sensor 14 retains a captive, externally-threaded fastener 24 operable for engaging an internally-threaded tripod mount provided on the underside of the camera 12. The sensor 14 may further comprise a sensor switch that is biased in an extended position. As such, sensor switch moves from the extended position to a retracted or depressed position as the fastener 24 secures the camera 12 onto the sensor 14. In the depressed position, the sensor switch completes an electronic monitoring circuit or sense loop of sensor electronics 25 disposed within the sensor that is electrically connected to monitoring electronics disposed within display stand 20, as will be described, to indicate that the camera 12 is securely attached to the sensor. In the event that a potential thief attempts to separate the camera 12 from the sensor 14, for example, by unscrewing the fastener 24, or alternatively, by rotating the camera relative to the sensor housing, biased sensor switch extends and interrupts the monitoring circuit of sensor electronics to indicate that the camera is no longer securely attached to the sensor. In response to the sensor switch changing from a "secured" state to an "unsecured" or "alarm" state, the monitoring electronics of the display stand 20 may activate the audible alarm and/or visible alarm to alert store personnel to a possible theft.

As shown in FIGS. 1 and 2, a multi-conductor cable 80 may extend between the display stand 20 and the sensor 14 to electrically interconnect monitoring electronics disposed within the display stand with electronics disposed within the sensor. The monitoring electronics may be configured to detect when the cable 80 is cut or removed from the sensor 14 or display stand 20 in an unauthorized manner and to generate an audible and/or visible alarm in response thereto. Thus, the cable 80 may define a sense loop via a plurality of conductors extending therethrough, wherein interruption of the sense loop results in the generation of an alarm.

As readily appreciated and understood by those skilled in the art, the cable 80 may be provided with a releasable connector on one or both ends, or alternatively, may be hard-wired directly to the corresponding electronics disposed within display stand 20 and/or the sensor 14. The end of the cable 80 that is connected to the display stand 20 may be provided with a releasable connector (e.g., a plug connector) so as to facilitate the interchangeability of different display stands with the same sensor. Similarly, the end of cable 80 that is connected to the sensor 14 may be provided with a releasable connector. For instance, FIG. 2 shows an example where cable 80 includes a releasable connector 82 configured to removably engage an input port 84 on the sensor 14. A releasable connector 82 between the cable 80 and the sensor 14 may allow the sensor to be detached from the cable for allowing a customer to examine and operate the camera without the constraint of the cable tethering the camera to the display stand 20. Thus, the sensor 14 is in essence "quick release" due to the fact that the sensor may remain attached to the camera 12, and the cable 80 can be easily detached from the sensor.

It is understood that the illustrated embodiment including a display stand 20 is not intended to be limiting, as it is understood that the cable 80 may alternatively be tethered or electrically connected to other display surfaces, supports, remote alarm modules, etc. In other embodiments, the cable 80 may be electrically connected between the sensor 14 and an external power source. The cable 80 may be directly or indirectly connected to an external power source so as to be in electrical communication therewith. For example, the display stand may be disposed between the sensor and the external power source such that the cable is indirectly connected with the external power source. In another example, an end of the cable connects directly to an external power source. In other embodiments, a cable 80 may be omitted, such as where wireless charging (e.g., inductance) or contact charging is employed.

If desired, the sensor electronics 25 may be configured for determining whether the internal power source 15 requires charging and/or the voltage of the internal power source. For example, the sensor electronics 25 may be configured to determine whether the internal power source 15 has a full charge. In some cases, the sensor electronics 25 may include a charging circuit for determining whether to transfer power to the internal power source 15. If the internal power source does not have a full charge, the sensor electronics 25 may be configured to transfer power to the internal power source 15 via the flexible circuit 90, as described below. As such, the sensor electronics 25 may be configured to provide a "trickle" charge to the internal power source 15 for providing power to the internal power source only when necessary. In some embodiments, the sensor electronics 25 includes a battery charging IC for determining whether the internal power source 15 requires charging and/or providing the appropriate voltage and/or current to the internal power source. Display stand 20 may contain an internal power source (e.g., a battery) for providing power to the monitoring electronics and the sensor electronics 25, or alternatively or additionally, may comprise a main power cord 22 that is electrically connected to an external power source, such as a direct current (DC) transformer and an alternating current (AC) electrical outlet.

Figure 3:
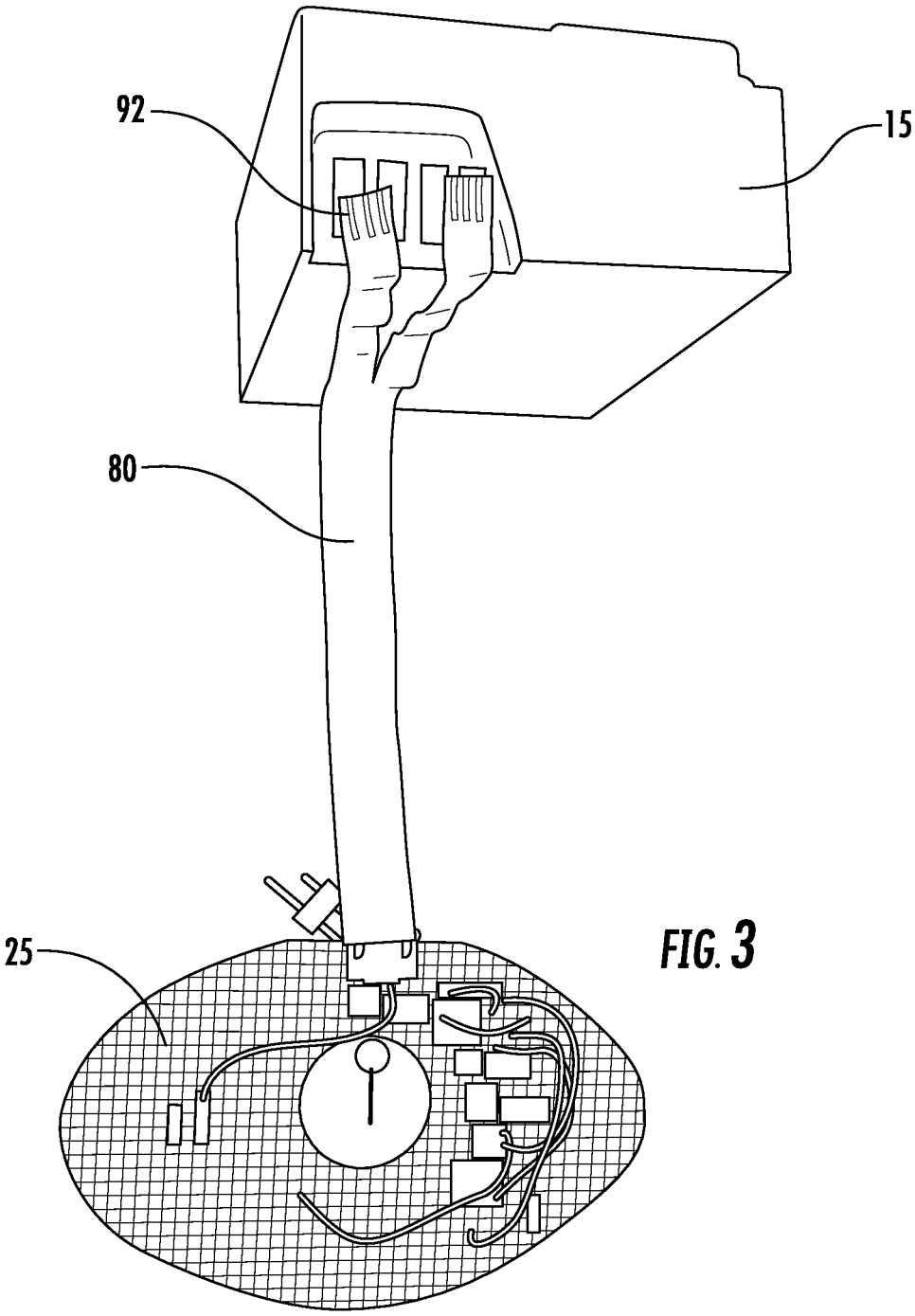
FIG. 3 is a perspective view of a flexible circuit extending between a sensor and a power source according to one embodiment of the present invention.

According to one embodiment shown in FIG. 3, a flexible circuit 90 extends between the sensor 14 and the internal power source 15 of the camera 12. The flexible circuit 90 is configured to be in electrical communication with the internal power source 15 and the sensor 14. The flexible circuit 90 may comprise conductors 92 that carry the appropriate operating current and/or voltage to the internal power source 15 from the sensor electronics 25. Thus, where the cable 80 is configured to transmit power to the sensor 14, the flexible circuit 90 is configured to transmit power from the sensor to the internal power source. In some embodiments, the flexible circuit 90 may comprise means (e.g., a resistor) for determining the appropriate current and/or voltage requirements of the internal power source 15 and/or regulating the voltage provided to the internal power source. The flexible circuit 90 may then be configured to communicate with the sensor electronics 25 with the appropriate current and/or voltage requirements. As such, the flexible circuit 90 is adaptable for use with different internal power sources 15 having varying power and voltage requirements. The flexible circuit 90 is thus able to facilitate charging of the internal power source 15, such as when the cable 80 is electrically connected to the sensor 14. In some embodiments, the flexible circuit 90 may include a thermal sensor or other thermal detection means (e.g., a thermistor). The thermal sensor could be used to detect a temperature of the internal power source 15 and communicate with the sensor 14 to ensure that the internal power source does not overheat or overcharge. In some cases, the thermal sensor may be attached directly to the internal power source 15.

In some embodiments, the flexible circuit 90 may include one or more conductors 92 configured to define a sense loop. For example, where the cable 80 defines a sense loop, the flexible circuit 90 may include conductors 92 that are in electrical communication with the conductors in the cable 80 defining the sense loop. As such, should the flexible circuit 90 be cut or disconnected, the monitoring electronics may be configured to detect this interruption and generate an audible and/or a visible alarm.

As noted above, the flexible circuit 90 may comprise one or more conductors 92 that electrically interconnect the internal power source 15 with the sensor electronics 25. Where the internal power source 15 is a battery, the conductors 92 may be attached directly to the terminals of the battery (see, e.g., FIG. 3). For example, the conductors 92 may be attached directly to the battery terminals. The conductors 92 of the flexible circuit 90 may be arranged on the internal power source 15 such that the conductors are in electrical communication with the internal power source and the electronics of the camera 12. Thus, the conductors 92 may be disposed between the internal power source 15 and the camera electronics without hindering the operation of the camera 12. For instance, the conductors 92 of the flexible circuit 90 may be sandwiched between the terminals of the camera battery and conductive pins disposed within the camera. Likewise, the conductors 92 of the flexible circuit 90 may be attached directly to the sensor electronics 25 to establish electrical communication between the sensor 14 and the internal power source 15, as well as the conductors in the cable 80. For example, the conductors 92 of the flexible circuit 90 may be hardwired to the sensor electronics 25. In addition, the flexible circuit 90 may be configured to extend through an opening defined in the sensor 14 and conform to the sensor and camera 12 so as to be generally unnoticeable by a customer. In some embodiments, the flexible circuit 90 may be attached directly to the internal power source 15, such as with a releasable adhesive. Thus, the flexible circuit 90 may be removably attached to an internal power source 15, including an original equipment manufacturer (OEM) battery, without the need for hardwiring or other mechanical attachment.

According to one embodiment, the flexible circuit 90 has a suitable length that allows the flexible circuit to extend within an internal compartment of the camera 12, such as a battery compartment, and allow a movable door 17 to close when the flexible circuit is extending within the compartment (see, e.g., FIG. 2). Thus, the flexible circuit 90 does not inhibit use of the battery compartment of the camera 12. The flexible circuit 90 is also flexible so as to be bendable for extending from the internal power source 15 to the sensor 14. In some embodiments, the flexible circuit 90 is ribbon like and bendable without permanently deforming the flexible circuit. As such, the flexible circuit 90 is thin and flexible so as to not hinder closing of the battery compartment door 17. In addition, the flexible circuit 90 eliminates the need for an external cable connecting the sensor 14 to an input port of the camera, commonly referred to in the art as "power adapter cords" or "pigtails", for providing power to the camera. Notably, these power adapter cords and pigtails are typically not configured to charge the internal power source of the camera but only serve to provide power to the camera while tethered to a display stand.

Because the flexible circuit 90 facilitates charging of the internal power source 15 of the camera 12 when the sensor 14 is connected to the cable 80, the camera will be assured of having sufficient power to allow the customer to operate the camera when the sensor is detached from the cable. Furthermore, because the flexible circuit 90 facilitates charging of the internal power source 15 when the sensor 14 is electrically connected to the cable 80, retailers do not need to remove batteries from the camera for recharging or replace the batteries. Removal of the batteries can be inconvenient to retailers and cumbersome to replace especially where the sensor 14 first needs to be removed in order to do so. In addition, because the flexible circuit 90 facilitates charging of the internal power source 15 of the camera 12, the sensor 14 is not required to have its own internal power source for powering the camera when the cable 80 is disconnected from the sensor.

Figure 4:
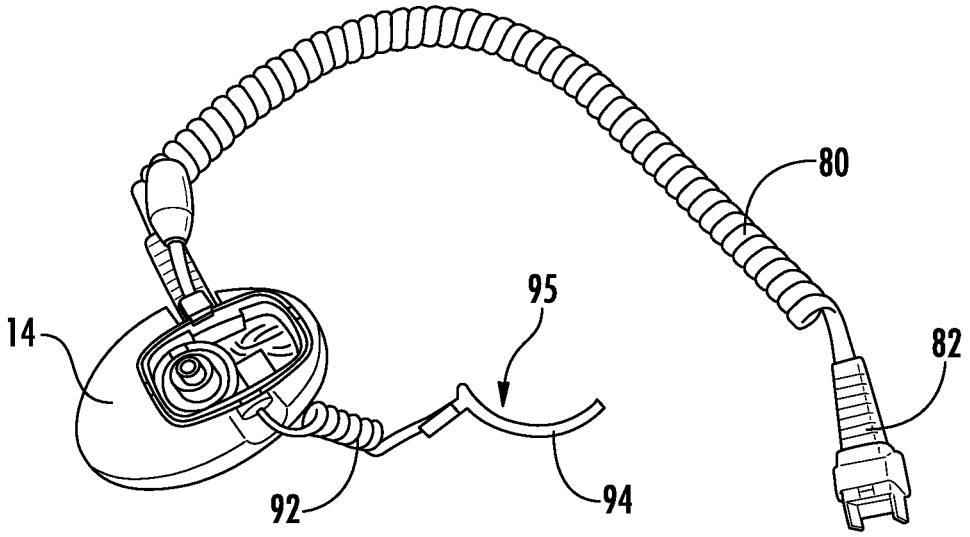
FIG. 4 is a perspective view of a sensor including a secondary sensor according to one embodiment of the present invention.
Figure 5:
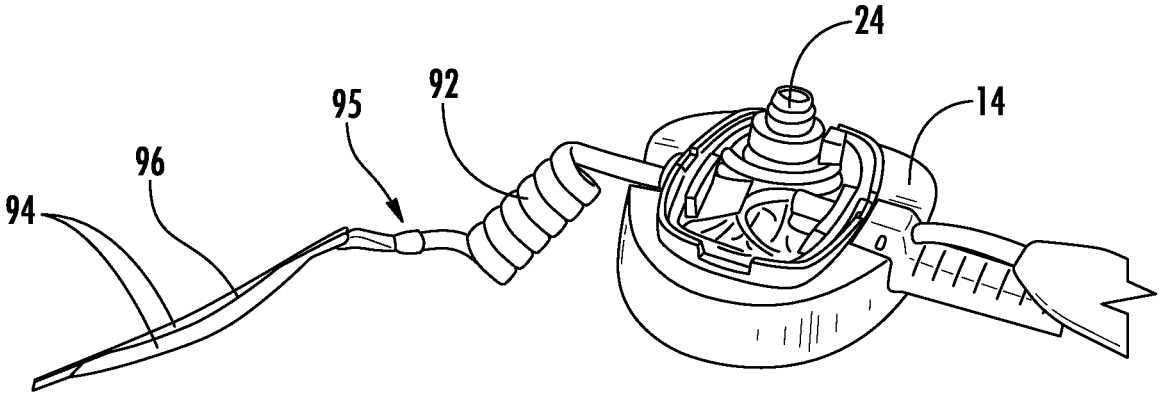
FIG. 5 is an enlarged perspective view of the sensor and the secondary sensor shown in FIG. 4.

According to another embodiment shown in FIGS. 4-5, the merchandise security device 10 further includes a secondary sensor 95. The secondary sensor 95 is shown coupled to the sensor 14 so as to be in electrical communication therewith. The secondary sensor 95 may be hardwired to the sensor 14 or removably connected thereto (e.g., with a plug connector). In some embodiments, the secondary sensor 95 includes a cable 92 comprising one or more conductors that are in electrical communication with the sensor 14. Thus, a sense loop may be defined through the cable 80, sensor 14, and the cable 92. As such, should the secondary sensor 95 be cut or disconnected, the monitoring electronics may be configured to detect this interruption and generate an audible and/or visible alarm.

According to embodiments of the present invention, the secondary sensor 95 may include a flexible component 94, as shown in FIGS. 4-5. The flexible component 94 may be electrically connected to an end of the cable 92 opposite the sensor 14. In one example, the flexible component 94 comprises an electrically conductive material. The flexible component 94 may be formed of shape memory material or biased into a desired configuration. In one embodiment, the flexible component 94 is curved for conforming to a curvature of a camera lens, although the flexible component may have any desired shape. Moreover, the flexible component 94 may include a pair of contacts that are biased away from one another (see, e.g., FIG. 5). Thus, in a relaxed state (i.e., with no external forces being applied), at least a portion of the pair of contacts are not in direct contact with one another. For example, the ends of the contacts may be attached to one another, while the portion of the contacts between the ends may not be in contact with one another in a relaxed state. An opening 96 could be defined between the contacts, such as by forcing the ends towards one another and then attaching the ends together (e.g., via adhesives, tape, welding, or the like). One end of the contacts may be electrically connected to the cable 92. The contacts are flexible so as to be configured to be forced towards one another and into direct physical contact with one another. When in contact with one another, the contacts are configured to complete a sense loop or circuit through the secondary sensor 95. For example, the contacts may be electrically connected to conductors extending through the cable 92. When the contacts are separated from one another in an unauthorized manner or before disarming the monitoring electronics, the monitoring electronics may detect the interruption in the sense loop and generate an audible and/or visible alarm.

Figure 6:
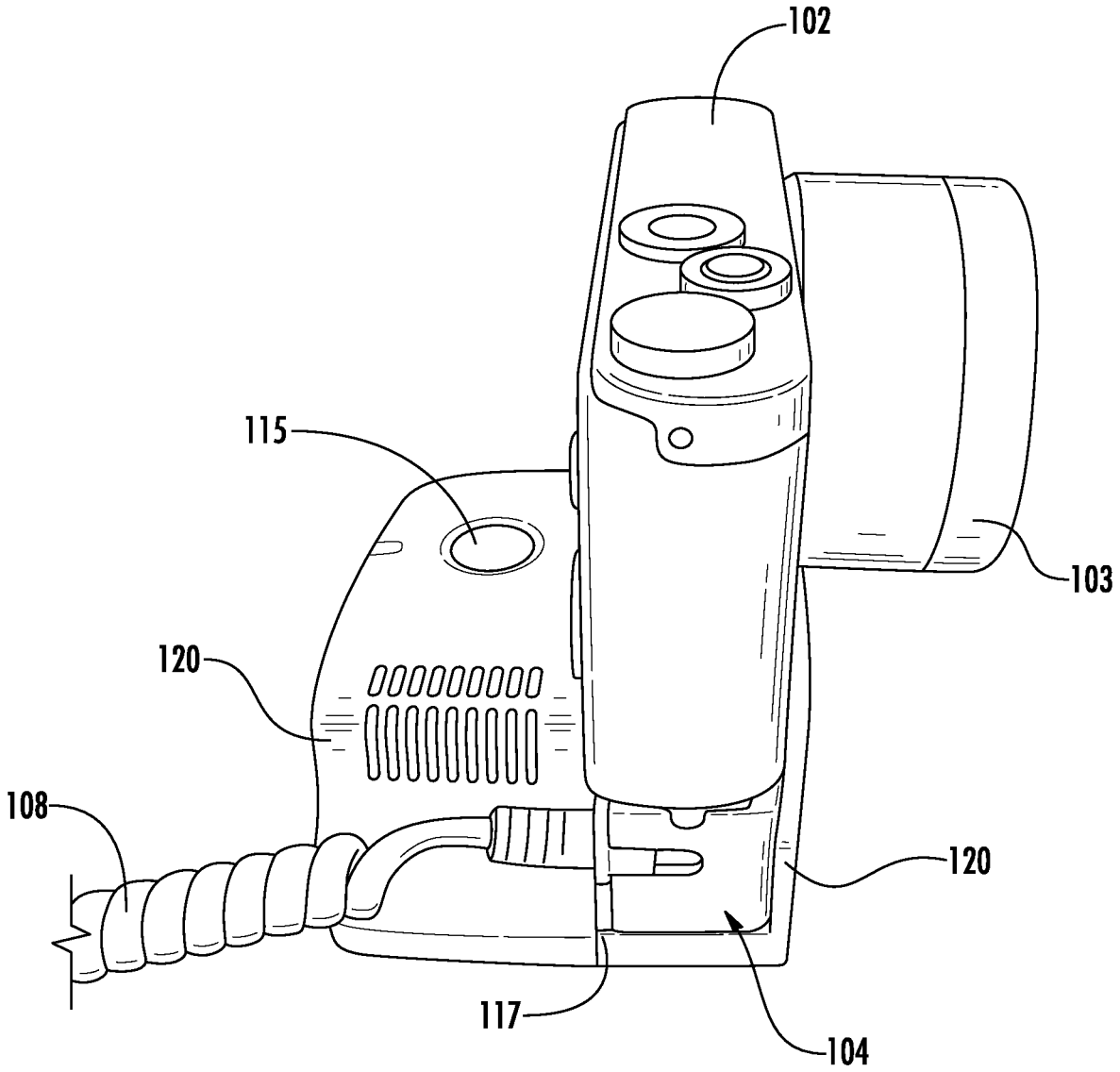
FIG. 6 is a perspective view of a merchandise display security device secured to a camera according to another embodiment of the present invention.

FIGS. 6-10 illustrate another embodiment of a merchandise display security device 100 including an embodiment of a sensor 104 configured for use with a camera 102 having a removable lens 103. The security device 100 may include a display stand 120 for removably supporting the sensor 104 thereon. The display stand 120 may include a transfer port 115 for communicating with a key for arming or disarming the monitoring electronics. In one embodiment, the transfer port 115 is configured to communicate wirelessly with a key in order to determine whether the key is authorized to arm and/or disarm the monitoring electronics. Furthermore, the side view of FIG. 6 shows that the display stand may include a slot 117 configured to receive a portion of the sensor 104 therein. Thus, when positioned in the slot 117, the sensor 104 and the camera 102 are removably supported therein.

Figure 8:
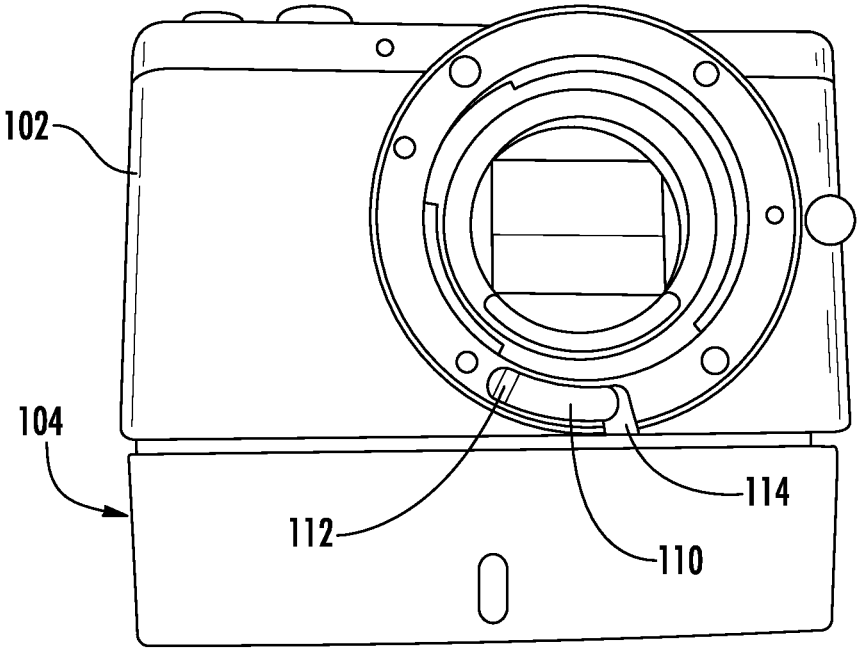
FIG. 8 is a front view of the camera and the sensor shown in FIG. 6 with the camera lens removed to show a secondary sensor.
Figure 9:
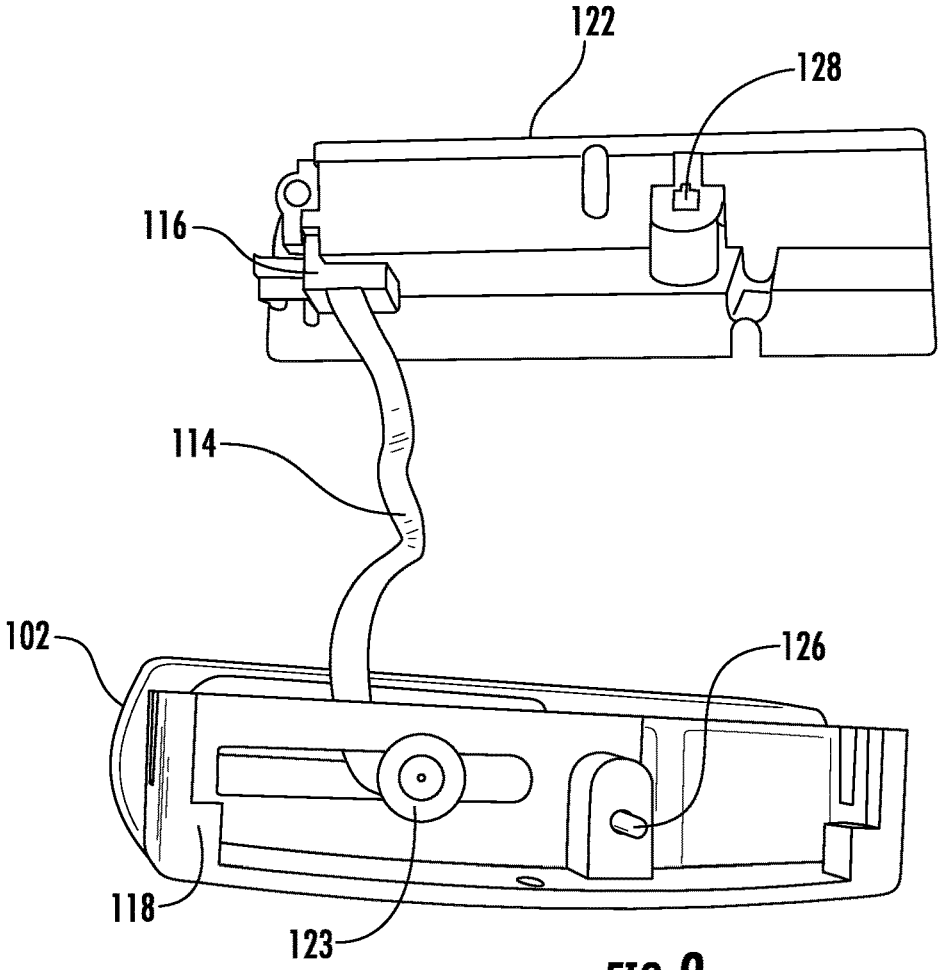
FIG. 9 is a partially disassembled view of the sensor shown in FIG. 6.

Similar to the embodiment discussed above, the merchandise display security device 100 includes a secondary sensor 110 (see, e.g., FIG. 8). Rather than using a cable, the secondary sensor 110 is shown coupled to the sensor 104 via a flexible circuit 114 so as to be in electrical communication therewith. The flexible circuit 114 may include one or more conductors that are configured to be in electrical communication with the sensor electronics and the conductors in the cable 108. As shown in FIG. 9, an end of the flexible circuit 114 opposite the secondary sensor 110 may include a releasable connector 116 for engaging the sensor 104 and establishing electrical communication with the sensor. However, it is understood that the flexible circuit 114 could be hardwired to the sensor 104 if desired. In one embodiment, the secondary sensor 110 is integrally formed with the flexible circuit 114, while in other embodiments, the secondary sensor is attached to the flexible circuit. Thus, the flexible circuit 114 may include means to protect a removable component, such as a removable lens 103.

As shown in FIG. 9, it can be seen that the sensor 104 may include an upper portion 118 and a lower portion 122. The upper portion 118 may be configured to engage a lower surface of the camera 102, such as with a fastener 123 that engages the tripod hole of the camera. The lower portion 122 may be configured to receive the upper portion 118 and secured thereto such that the fastener 123 is inaccessible. The upper 118 and lower 122 portions may be secured together using one or more fasteners. The lower portion 122 may be electrically connected to an end of the cable 108 extending to the stand 120. In addition, the flexible circuit 114 is configured to be positioned between the upper 118 and lower 122 portions such that the flexible circuit is also inaccessible without first disengaging the upper and lower portions. In some cases, only a small length of the flexible circuit 114 may be visible when the removable lens 103 is secured to the camera 102 (see, e.g., FIG. 8). FIG. 9 also shows that a portion of the flexible circuit 114 may be positioned between the upper portion 118 and the bottom surface of the camera 102. Moreover, FIG. 9 shows that the upper portion 118 may include a pressure switch 126 that is configured to detect when the sensor 104 is removed from the camera 102. The lower portion 122 may include a switch 128 that is operably engaged with the pressure switch 126 and in electrical communication with the monitoring electronics. Thus, should the sensor 104 be removed from the camera 102 or the upper portion 118 removed from the lower portion 122, the monitoring electronics may be configured to detect this removal and generate an audible and/or a visible alarm.

Figure 10:
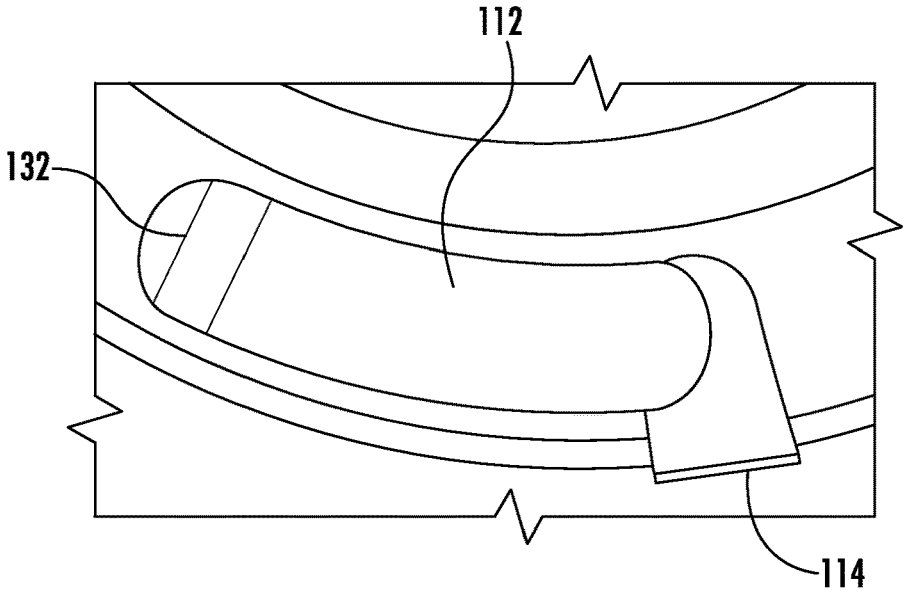
FIG. 10 is an enlarged view of the secondary sensor shown in FIG. 8.

Similar to the embodiments discussed above, the secondary sensor 110 may include a flexible component 112 that is configured to be in electrical communication with the flexible circuit 114 (see, e.g., FIG. 10). In this regard, the flexible component 112 may be biased into engagement with a conductor 130 electrically connected to the flexible circuit 114 (see, e.g., FIG. 11). Therefore, the flexible component 112 and conductor 130 may function in a similar manner as the contacts discussed above in order to complete an electrical circuit. For example, the conductor 130 may be electrically connected to one or more conductors in the flexible circuit 114. Contact between the flexible component 112 and the conductor 130 may complete an electrical circuit. Thus, a sense loop may be defined through the cable 108, sensor 104, and the flexible circuit 114. As such, should the flexible circuit 114 and/or cable 108 be cut, torn, or disconnected, the monitoring electronics may be configured to detect this interruption and generate an audible and/or a visible alarm.

In one example, the flexible component 112 comprises an electrically conductive material. The flexible component 112 may be formed of shape memory material or biased into a desired configuration. In one embodiment, a portion of the secondary sensor 110 and the flexible component 112 are curved for conforming to a curvature of a camera lens (see, e.g., FIGS. 8 and 10), although the flexible component may have any desired shape. Moreover, the flexible component 112 may be biased away from the conductor 130. Thus, in a relaxed state (i.e., with no external forces being applied), at least a portion of the flexible component 112 and conductor 130 are not in direct contact with one another. The flexible component 112 is flexible so as to be configured to be forced towards the conductor 130 and into direct physical contact therewith. When in contact with one another, the flexible component 112 and conductor 130 are configured to complete a sense loop or circuit through the secondary sensor 110 and with the remaining conductors in the flexible circuit 114. When the flexible component 112 is separated from the conductor 130 in an unauthorized manner or before disarming the monitoring electronics, the monitoring electronics may detect the interruption in the sense loop and generate an audible and/or a visible alarm.

Figure 11:
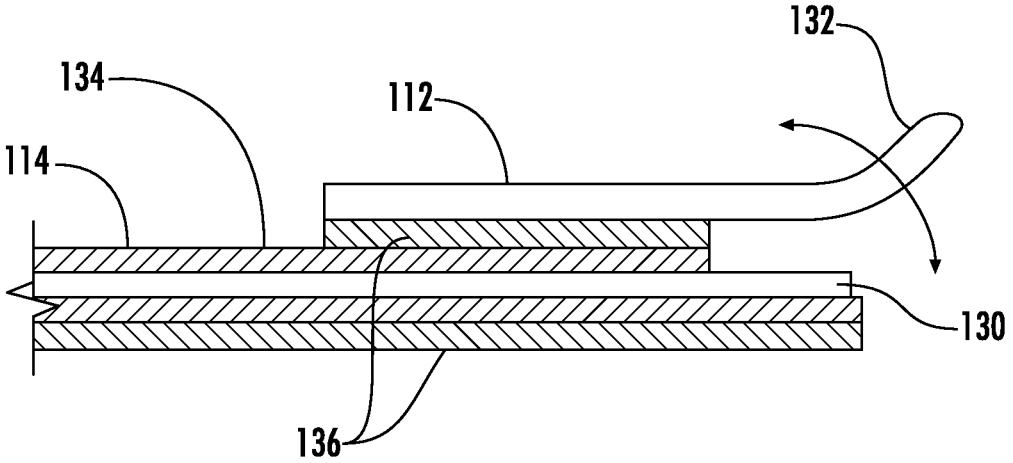
FIG. 11 is a cross-sectional view of a secondary sensor according to another embodiment of the present invention.

FIG. 11 shows an embodiment of an enlarged view of a flexible component 110, wherein an end of the flexible component includes a bend 132. The bend 132 may function as a contact spring to allow for a predetermined amount of tolerance or over travel before contact is broken between the flexible component 112 and the conductor 130. In this regard, when the removable lens 103 is secured to the camera 102, the bend 132 will be biased towards a position that is generally parallel to the conductor 130. Thus, should the removable component 103 be moved (but not removed) from the camera, the bend 132 may allow for some bias of the flexible component 112, but the sense loop will not be interrupted. Only when the removable component 103 is removed will the bend 132 bias to its relaxed state, and the flexible component 112 may in turn bias away from the conductor 130. Thus, the bend 132 may reduce the incidence of false alarms in some instances.

In one embodiment, FIG. 11 also shows that the flexible circuit 114 includes a conductor 130 (e.g., copper) that may be surrounded by, or otherwise coupled to, an insulating or non-conductive layer of material 134 (e.g., a polyimide file such as Kapton® polyimide film). A portion of the conductor 130 is exposed for electrically contacting the flexible component 112 when the flexible component is biased into engagement with the conductor to complete the electrical circuit. The conductor 130 may be a contact electrically connected to one or more conductors within the flexible circuit 114 or may extend along the entire length of the flexible circuit, and there may be more than one contact or conductor in some embodiments. FIG. 11 also shows that the flexible component 112 may be secured to the flexible circuit 114 with an adhesive layer 136 and that the flexible circuit may also include an adhesive layer 136 for securing to the camera 102.

Collectively, the conductors of the flexible circuit 114 are configured to define a sense loop in electrical communication with the sensor electronics and/or the monitoring electronics. Thus, where the cable 108 defines a sense loop, the flexible circuit 114 may include conductors that are in electrical communication with the conductors in the cable defining the sense loop. As such, should the flexible circuit 114 be cut or disconnected, the monitoring electronics may be configured to detect this interruption and generate an audible and/or a visible alarm.

The flexible circuit 114 may include a releasable adhesive (see, e.g., FIG. 11). For example, at least a portion of the flexible circuit 114 may be a "peel-and-stick" configuration for adhering to the camera 102. However, it is understood that other suitable techniques may be used to secure the flexible circuit 114 and secondary circuit 110 in position on the camera 102.

Figure 7:
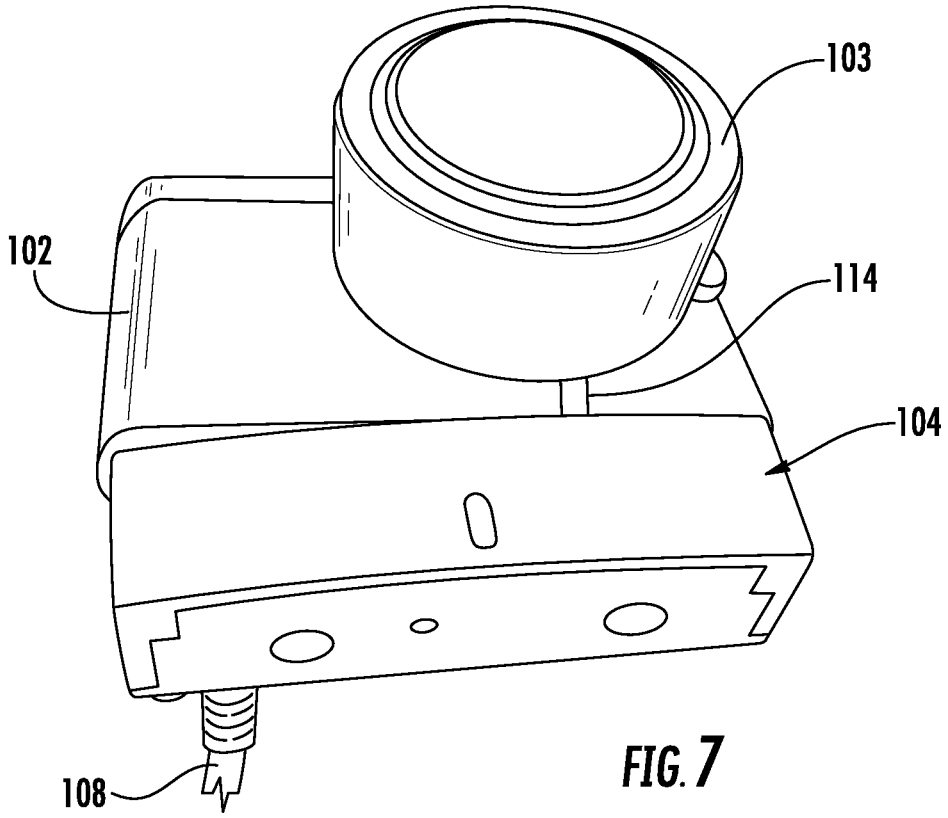
FIG. 7 is a bottom perspective view of the camera and the sensor shown in FIG. 6.

In one example, the flexible component 112 is configured to be positioned between a camera 102 and a removable lens 103 (see, e.g., FIG. 7). Thus, the flexible component 112 does not inhibit use of the lens 103 of the camera 102. The flexible component 112 is also flexible so as to be bendable for biasing to different states. In some embodiments, the flexible component 112 is thin and resilient such that the flexible component may be biased without permanently deforming the flexible component. In addition, the flexible component 112 may be forced to various configurations and return to its relaxed state in a repeatable manner. As such, the flexible circuit 114 may be thin and flexible so as to not hinder attachment of the lens 103 to the camera 102 and may be used over an extended period of time. In addition, the flexible component 112 eliminates the need for attaching an external sensor to the outer surface of the lens 103. Such external sensors may inadvertently become detached and cause false alarms since they are typically attached with adhesives, and the external sensors may take away from the presentation and use of the camera by a potential purchaser.

Figure 12:
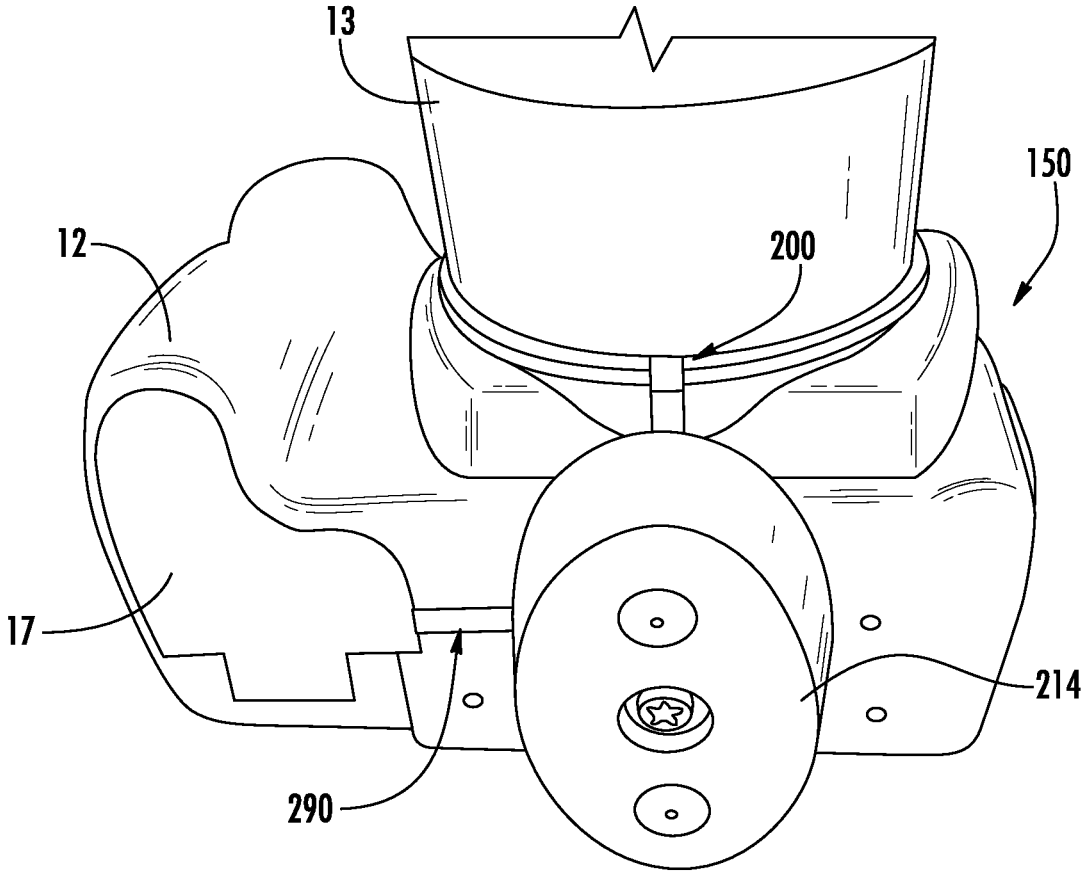
FIG. 12 is a bottom perspective view of a merchandise display security device secured to a camera according to one embodiment of the present invention.
Figure 13:
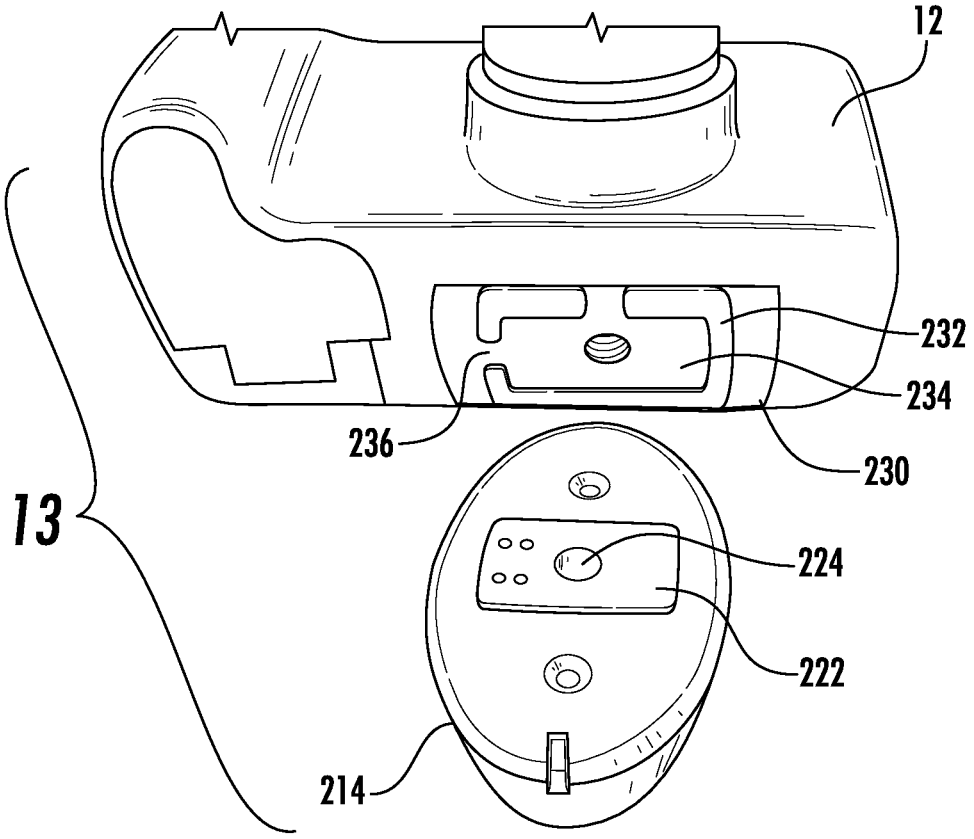
FIG. 13 is a bottom perspective view of the sensor shown in FIG. 12 removed from the camera.
Figure 14:
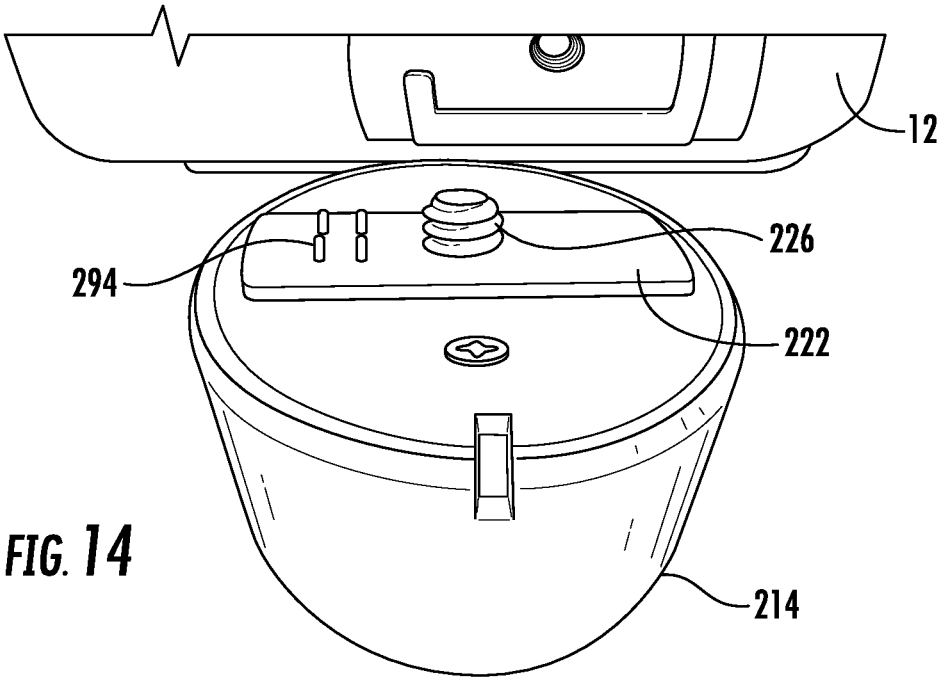
FIG. 14 is an enlarged perspective view of the sensor shown in FIG. 13.

FIGS. 12-14 illustrate another embodiment of a merchandise display security device 150. In this embodiment, the merchandise display device 150 includes a mounting plate 230 that is configured to be attached to the camera 12 (see, e.g., FIG. 13). The mounting plate 230 may be adhesively secured to the camera 12, such as with a pressure-sensitive adhesive. The mounting plate 230 may include a raised surface 232 that defines an opening 234 and one or more slots 236. The slots 236 are configured to receive a portion of a flexible circuit 290 as discussed in more detail below. FIGS. 13 and 14 illustrate that the sensor 214 may include a raised surface 222 that includes an opening 224 for receiving a fastener 226 therethrough. The opening 234 is configured to receive the raised surface 222 so as to align the sensor 214 on the camera 12, which in turn facilitates alignment of the flexible circuit 290 relative to the camera. In addition, the raised surface 222 may be at least partially inserted within the opening 234 such that the interaction between the raised surfaces 222, 232 limits rotation of the sensor 214. Thus, an unauthorized user is unable to rotate the sensor 214 relative to the camera 12 when the sensor is secured to the camera. In addition, the mounting plate 230 may also limit access to the electrical connection between the sensor 214 and the flexible circuit 290, which may reduce instances of shorting of the internal power source.

Figure 15:
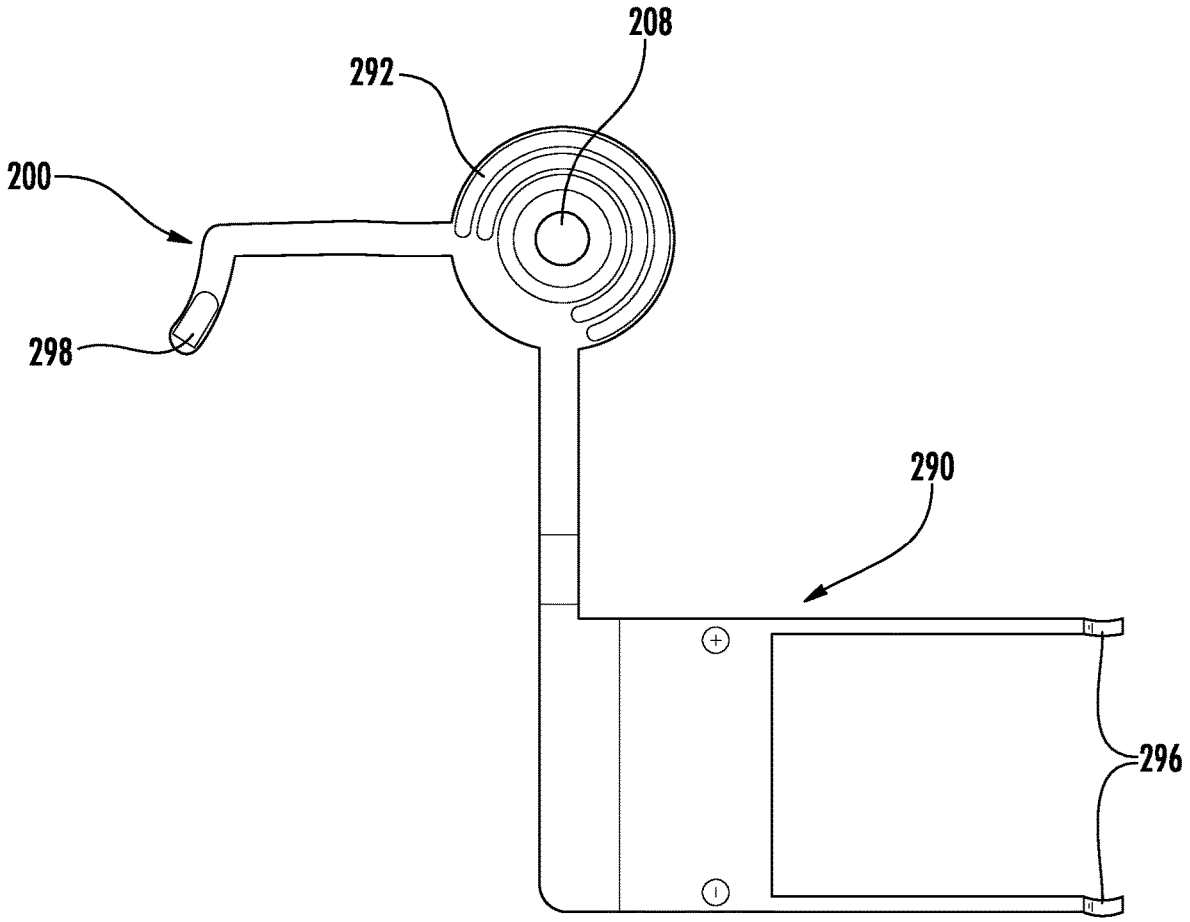
FIG. 15 is a plan view of a flexible circuit according to one embodiment of the present invention.

According to one embodiment shown in FIGS. 12 and 15, a flexible circuit 290 is configured to extend between the sensor 214 and the internal power source 15 of the camera 12. The flexible circuit 290 is configured to be in electrical communication with the internal power source 15 and the sensor 214, similar to that described above. The flexible circuit 290 may comprise conductors 292 that facilitate the transfer of the appropriate operating current and/or voltage to the internal power source 15 from the sensor 214. In one embodiment shown in FIGS. 14-15, the flexible circuit 290 includes conductors 292 configured to electrically connect to resilient conductors 294 on the sensor. The resilient conductors 294 may be configured to extend and retract relative to the sensor 214 surface. For example, the resilient conductors 294 may be pogo pins or spring contacts. Thus, the resilient conductors 294 may function in a similar manner as a sensor or plunger switch for detecting removal of the sensor 214 from the camera 12, as discussed above. Any number of resilient conductors 294 may be employed and may be located at any desired location on the sensor 214 for aligning with appropriate conductors 292 on the flexible circuit 290. Moreover, the flexible circuit 290 may also include conductors 296 for electrical connection to the internal power source 15. For example, the flexible circuit 290 may include a pair of conductors 296 that are spaced apart from one another. The flexible circuit 290 may further include a secondary sensor conductor 298, as explained in further detail below. Collectively, the conductors 292, 296, 298 of the flexible circuit 290 are configured to define a sense loop in electrical communication with the sensor electronics and/or the monitoring electronics. Thus, where a cable 80 connected to the sensor 214 defines a sense loop, the flexible circuit 290 may include conductors 292, 296, 298 that are in electrical communication with the conductors in the cable defining the sense loop. As such, should the flexible circuit 290 be cut or disconnected, the monitoring electronics may be configured to detect this interruption and generate an audible and/or a visible alarm.

As noted above, the flexible circuit 290 may comprise one or more conductors 292, 296, 298 that electrically interconnect the internal power source 15 with the sensor electronics 25. Where the internal power source 15 is a battery, the conductors 296 may be attached directly to the terminals of the battery. For example, the conductors 296 may be attached directly to the battery terminals. The conductors 296 of the flexible circuit 290 may be arranged on the internal power source 15 such that the conductors are in electrical communication with the internal power source and the electronics of the camera 12. Thus, the conductors 296 may be disposed between the internal power source 15 and the camera electronics without hindering the operation of the camera 12. For instance, the conductors 296 of the flexible circuit 290 may be sandwiched between the terminals of the camera battery and conductive pins disposed within the camera 12. In some embodiments, the conductors 292 of the flexible circuit 290 are not required to be hardwired to the sensor electronics. For example, the conductors 292 may be configured to contact and establish electrical communication with conductors 294. In addition, the flexible circuit 290 may be configured to conform to the surfaces of the sensor 214 and camera 12 so as to be generally unnoticeable by a customer. In some embodiments, the flexible circuit 290 may be attached directly to the internal power source 15, the camera 12, and/or removable lens 13, such as with a releasable adhesive. Thus, the flexible circuit 290 may be removably attached to an internal power source 15, including an original equipment manufacturer (OEM) battery, and the camera 12 without the need for hardwiring or other mechanical attachment.

According to one embodiment and similar to that described above, the flexible circuit 290 has a suitable length that allows the flexible circuit to extend within an internal compartment of the camera, such as a battery compartment, and allow a movable door 17 to close when the flexible circuit is extending within the compartment (see, e.g., FIG. 12). Thus, the flexible circuit 290 does not inhibit use of the battery compartment of the camera 12. The flexible circuit 290 is also flexible so as to be bendable for extending from the internal power source 15 to the sensor 215 and conforming to a surface contour of the camera 12. In some embodiments, the flexible circuit 290 is ribbon like and bendable without permanently deforming the flexible circuit.

According to one embodiment, the flexible circuit 290 further includes a secondary sensor 200 (see, e.g., FIGS. 12 and 15). Similar to that described above, the secondary sensor 200 is configured to be positioned between a camera 12 and a removable lens 13. The secondary sensor 200 is shown coupled to the sensor 214 so as to be in electrical communication therewith. In one embodiment, the secondary sensor 200 is integrally formed with the flexible circuit 214. Thus, the flexible circuit 200 may include both means to transfer power to the internal power source 15 and means to protect a removable component, such as a removable lens 13. As noted above, the secondary sensor 200 may include a conductor 298 that is configured to be in electrical communication with the sensor 214. Thus, a sense loop may be defined through the cable 80, sensor 214, and the flexible circuit 290. As such, should the flexible circuit 214 and/or cable 80 be cut, torn, or disconnected, the monitoring electronics may be configured to detect this interruption and generate an audible and/or a visible alarm.

Figure 18:
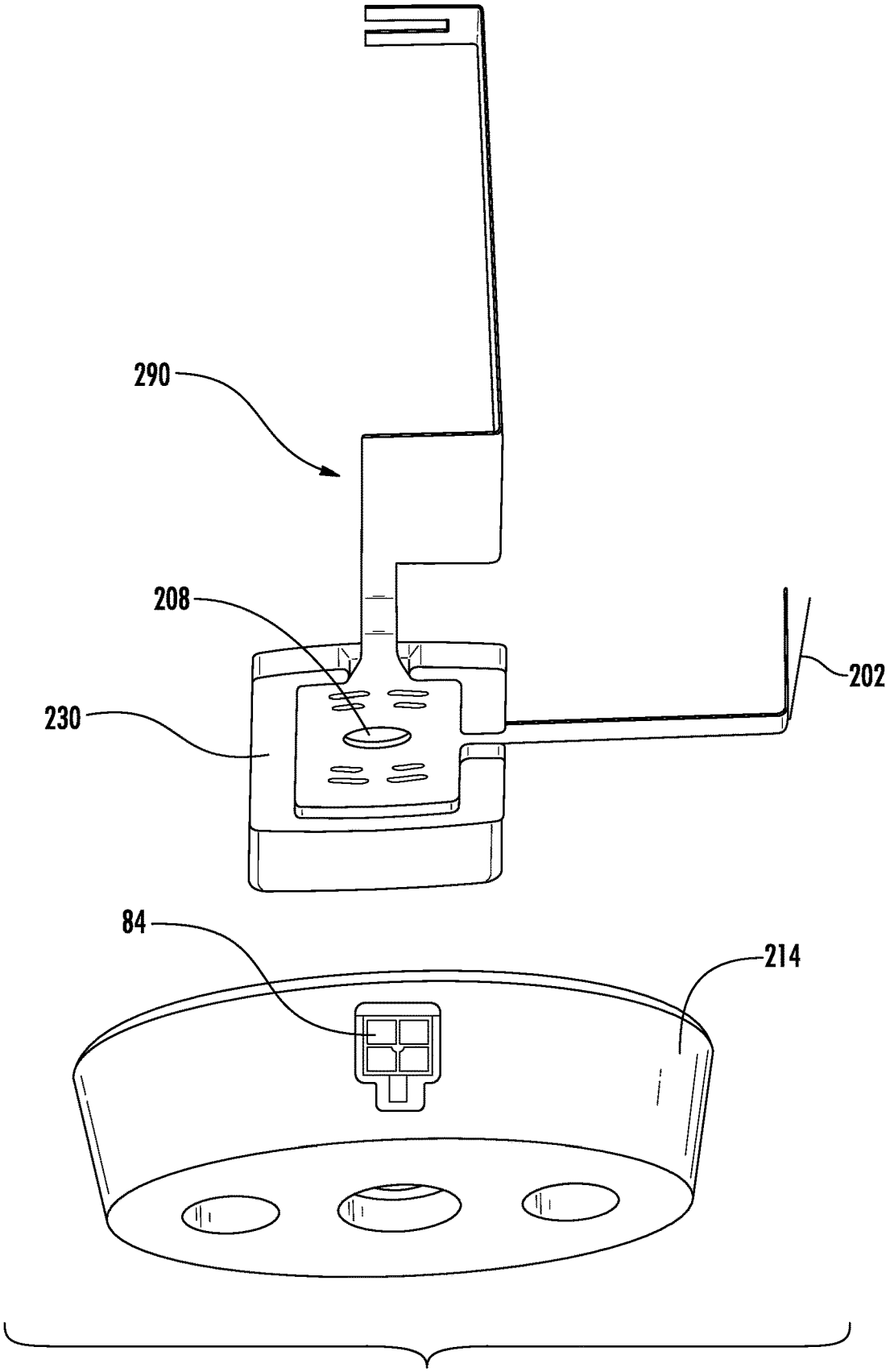
FIG. 18 is another perspective view of the merchandise display security device shown in FIG. 17.

According to embodiments of the present invention and similar to that described in the aforementioned discussion, the secondary sensor 200 may include a flexible component 202, as shown in FIG. 18. The flexible component 202 is configured to be electrically connected to the conductor 298. In one example, the flexible component 202 comprises an electrically conductive material. The flexible component 202 may be formed of shape memory material or biased into a desired configuration. In one embodiment, a portion of the secondary sensor 200 and the flexible component 202 are curved for conforming to a curvature of a camera lens 13, although the flexible component may have any desired shape. Moreover, the flexible component 202 may be biased away from the conductor 298. Thus, in a relaxed state (i.e., with no external forces being applied), at least a portion of the flexible component 202 and conductor 298 are not in direct contact with one another. The flexible component 202 is flexible so as to be configured to be forced towards the conductor 298 and into direct physical contact therewith. When in contact with one another, the flexible component 202 and conductor 298 are configured to complete a sense loop or circuit through the secondary sensor 200 and with the remaining conductors in the flexible circuit 290. When the flexible component 202 is separated from the conductor 298 in an unauthorized manner or before disarming the monitoring electronics, the monitoring electronics may detect the interruption in the sense loop and generate an audible and/or a visible alarm.

Figure 16:
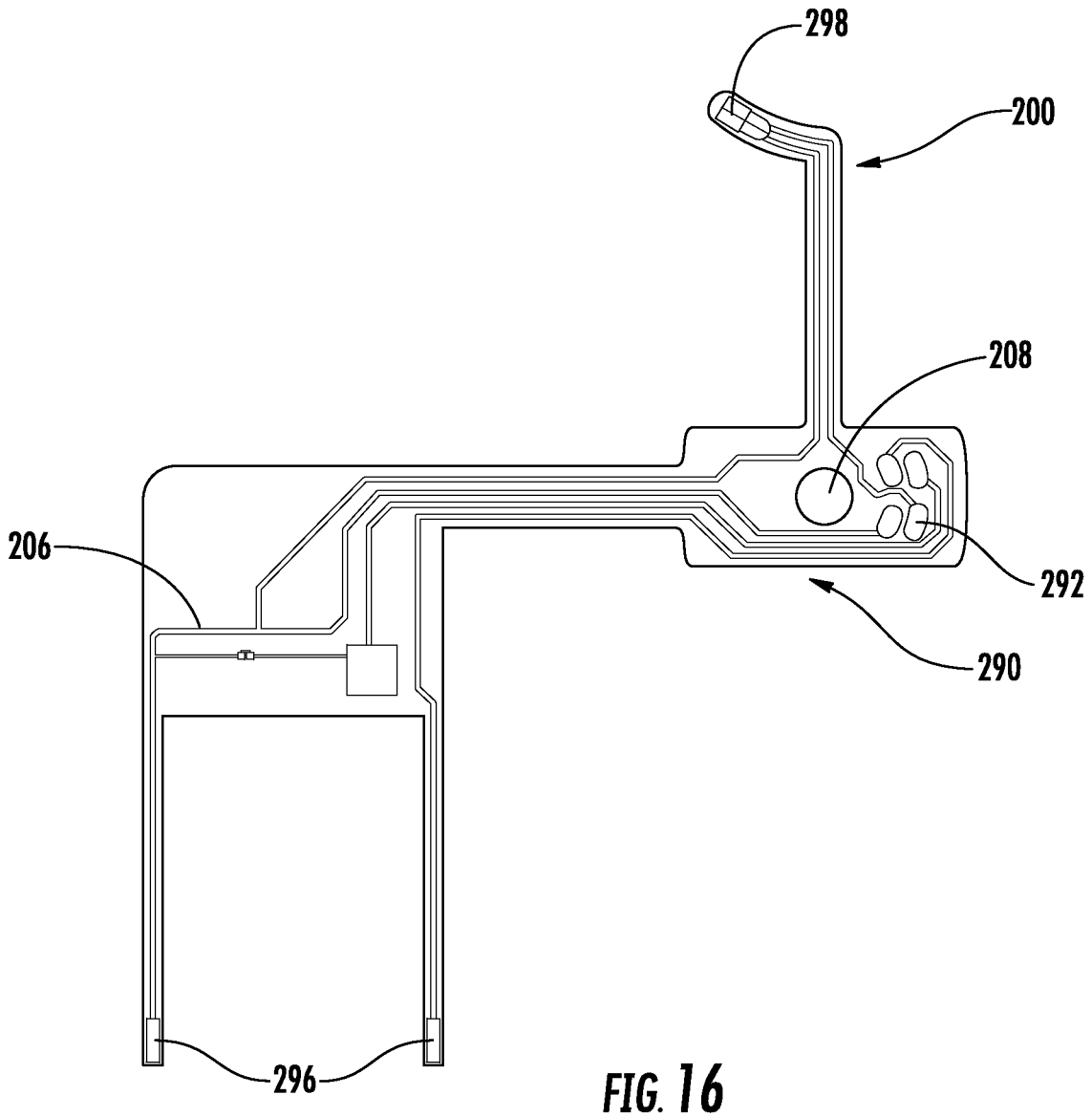
FIG. 16 is a plan view of a flexible circuit according to another embodiment of the present invention.

FIGS. 15 and 16 illustrate example configurations of a flexible circuit 290. It is understood that the flexible circuit 290 may have any suitable shape and size for accommodating various camera 12 and lens 13 manufacturers. For example, the flexible circuit 290 may be modified to accommodate different sized cameras 12 and lenses 13, as well as have different shapes to accommodate different types of internal power sources 15. As shown, the flexible circuit 290 may be integrally formed from a single piece of flexible material and include conductive traces 206 in electrical communication with each of the conductors 292, 296, 298. As such, a sense loop may be defined between the conductors 292, 296, 298. In addition, the location of the conductors 292, 296, 298 may be varied as appropriate. For example, FIG. 15 shows that conductors 292 may have a circular shape or follow a circular profile, while FIG. 16 shows that the conductors 292 may be non-circular and arranged in a variety of manners. For example, the conductors 292 may be adaptable to the location, size, and configuration of the resilient conductors 294 on the sensor 214.

Figure 17:
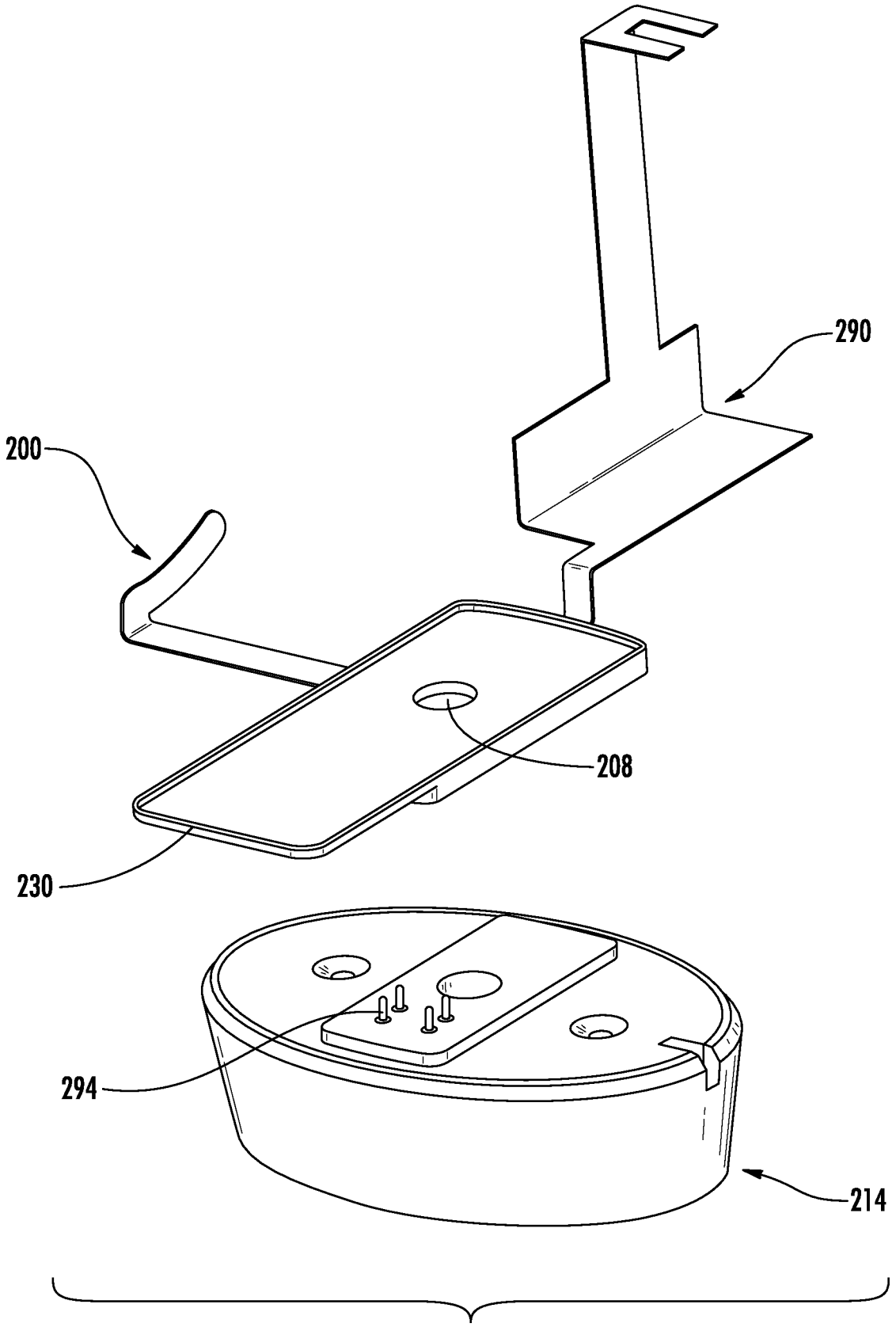
FIG. 17 is a partially disassembled perspective view of a merchandise display security device according to one embodiment of the present invention.
Figure 19:
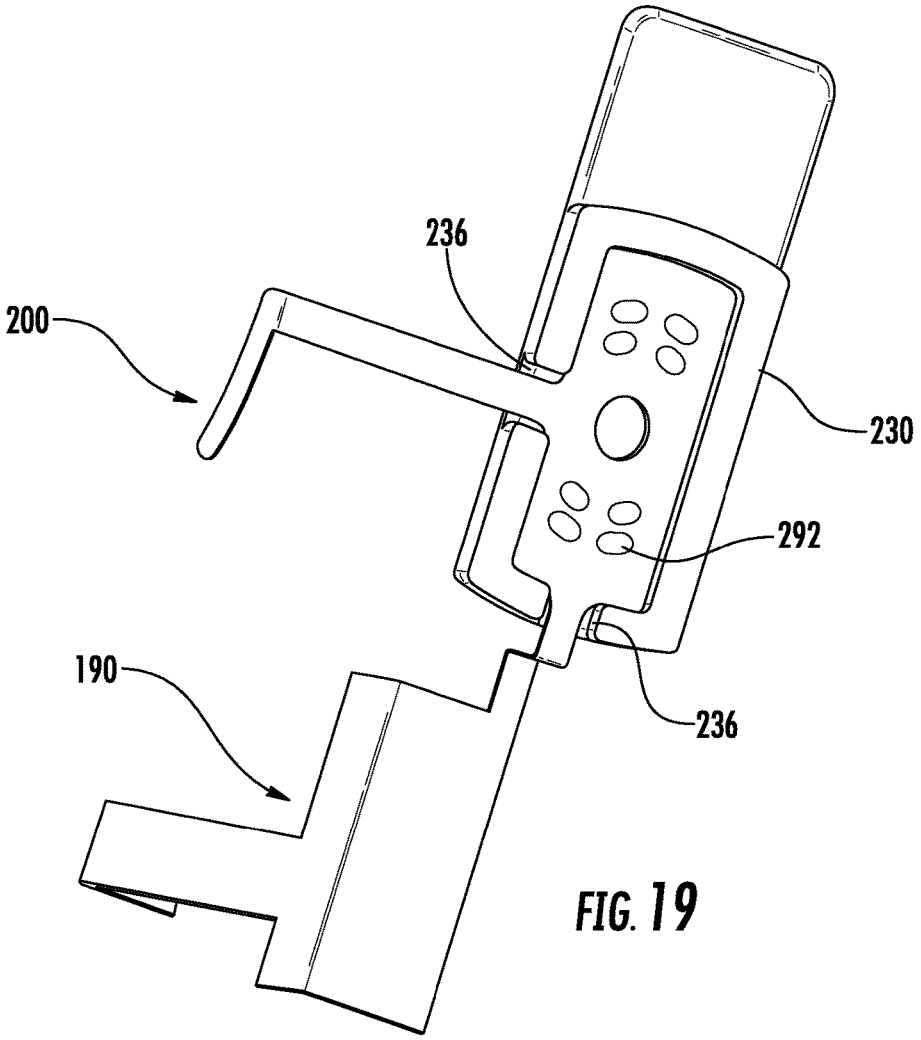
FIG. 19 is a perspective view of the flexible circuit and the mounting plate shown in FIG. 17.
Figure 20:
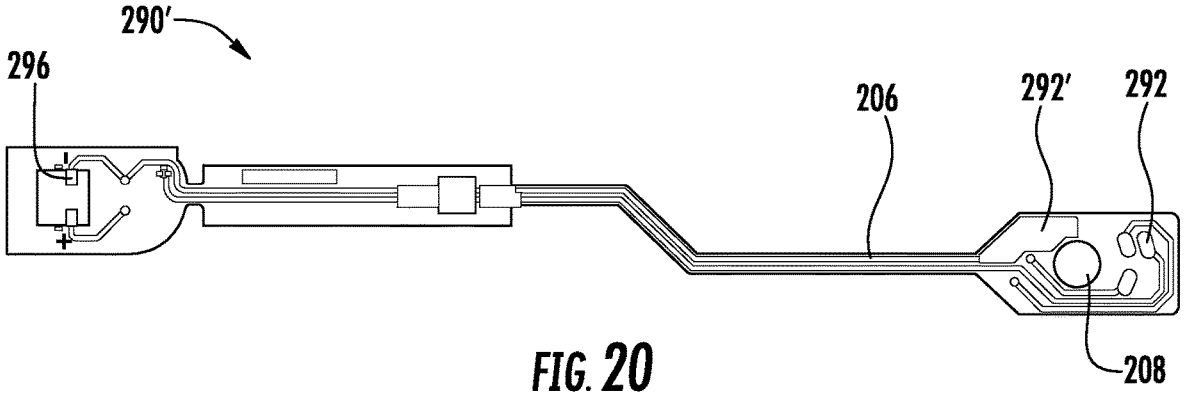
FIG. 20 is a plan view of a flexible circuit according to one embodiment of the present invention.
Figure 21:
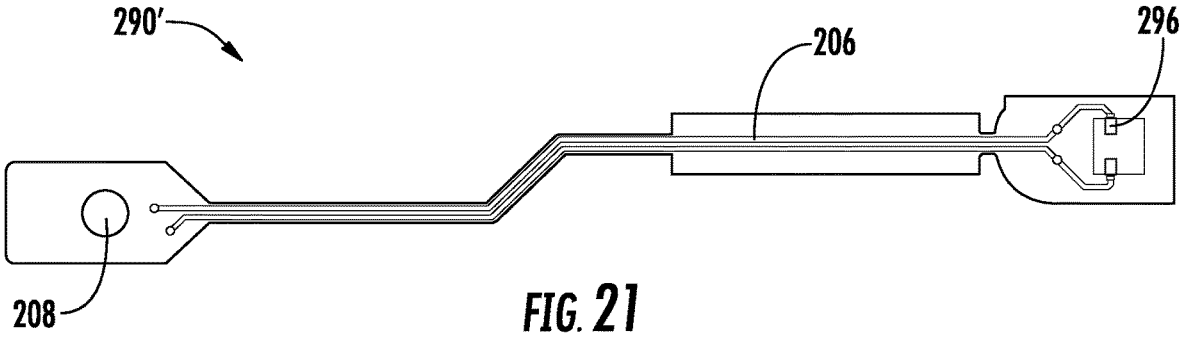
FIG. 21 is a rear plan view of the flexible circuit shown in FIG. 20.

FIGS. 17-19 illustrate another embodiment of a flexible circuit 290 and a sensor 214 with similar functionality as that described above. However, the particular shape of the flexible circuit 290 and the configuration of the sensor 214 are modified in this embodiment. Thus, it is apparent that the flexible circuit 290 and sensor 214 are readily adaptable to a variety of types of cameras 12 and lenses 13.

Similar to that described above, the flexible circuit 290 may include a releasable adhesive. For example, at least a portion of the flexible circuit 290 may be a "peel-and-stick" configuration for adhering to the camera 12 and the internal power source 15. Thus, the flexible circuit 290 may include a releasable backing material on one surface that may be removed to expose the adhesive. In one example, the entire surface on one side of the flexible circuit 290 includes a releasable adhesive. In the illustrated examples, the flexible circuit 290 may include an opening 208 for receiving a fastener 26 therethrough, such as for engaging a tripod hole in the camera 12.

In use according to one embodiment, one would typically position the conductors 296 in electrical communication with the conductors of the internal battery source 15. One could then pull all off a portion of the releasable backing so as to adhere the flexible circuit 290 to the internal power source 15. One could then insert the internal power source 15 into the battery compartment of the camera 12. If the mounting plate 230 has not already been attached to the camera 12, the mounting plate is attached to the camera. An alignment stud may be inserted into the tripod mount of the camera 12 for aligning the remaining portion of the flexible circuit 290 on the camera. Thus, the opening 208 defined in the flexible circuit 290 may be positioned over the stud, and the flexible circuit is aligned with the slots 236 defined in the mounting plate 230. If the releasable backing has not been removed, the releasable backing is removed in order to adhere the flexible circuit 290 to the camera 12 and the mounting plate 230. The flexible circuit 290 may then be adhered to the camera 12 and the mounting plate 230. The secondary sensor 200 may then be adhered to the camera 12 for alignment with the removable lens 13. The remaining releasable backing on the secondary sensor 200 is removed and the secondary sensor is adhered to the camera 12. The removable lens 13 may then be attached to the camera 12. The stud may be removed and disposed of for later use, and the sensor 214 may be attached to camera 12 with the fastener 26. As the fastener 26 is engaged, the conductors 292 align with and electrically connect to the resilient conductors 294 on the sensor. As such, a sense loop is defined between the sensor 214 and the flexible circuit 290.

FIGS. 20-23 illustrate alternative embodiments of a flexible circuit 290' and a secondary sensor 200'. In this particular example, the secondary sensor 200' may be modular rather than integrally formed with the flexible circuit 290'. This option may be useful in instances where a secondary sensor 200' is not needed (e.g., a camcorder or where a camera does not include a removable lens, such a point-and-shoot camera). As before, the flexible circuit 290' includes a plurality of conductors 292 at one end for electrically connecting to a sensor 214, wherein one or more of the conductors are electrically connected to one or more conductive traces 206. In this example, the flexible circuit includes three conductors 292 and another larger conductor 292'. The opposite end of the flexible circuit 290' includes conductors 296 configured to electrically connect to an internal power source 15 as discussed above, and one or more of the conductive traces 206 extend between the ends of the flexible circuit.

Figure 22:
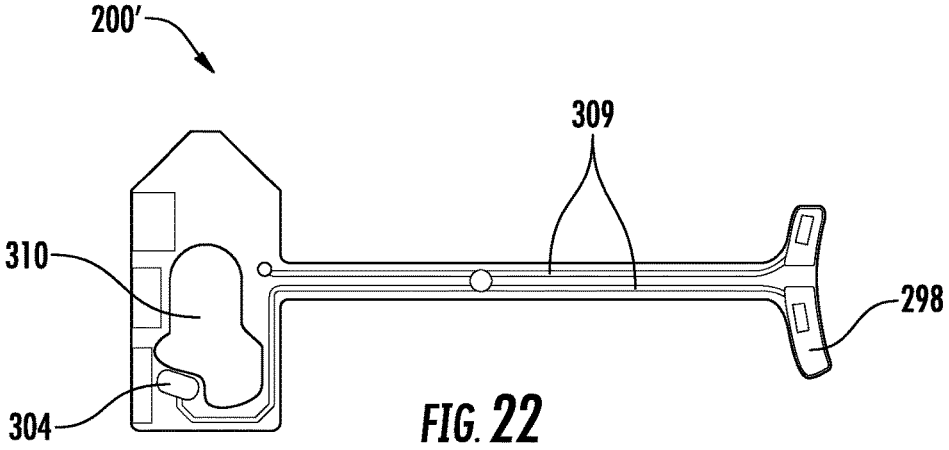
FIG. 22 is a plan view of a secondary sensor according to one embodiment of the present invention.
Figure 23:
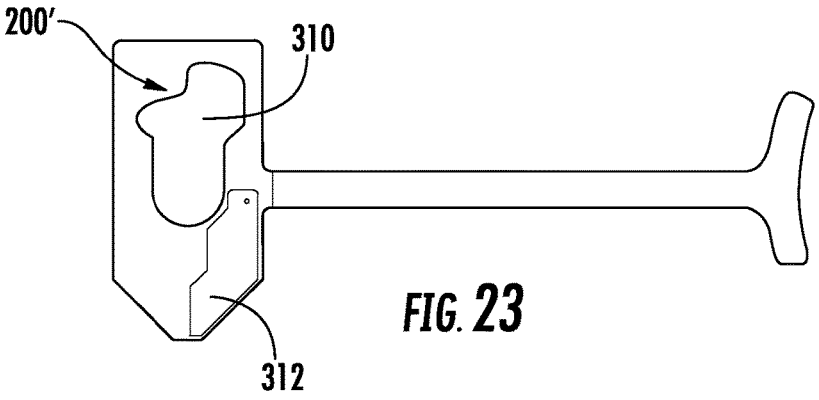
FIG. 23 is a rear plan view of the secondary sensor shown in FIG. 22.

FIGS. 22-23 illustrate a secondary sensor 200' according to one embodiment. As discussed above, a free end of the secondary sensor 200' may include at least one conductor 298 along with a flexible component 94, 112, 202. The base of the secondary sensor 200' may include at least one electrical contact 304, 312 that are electrically connected to conductive traces 309 and/or the contact 298. The secondary sensor 200' also includes an opening 310 defined therethrough. The opening 310 is configured to align with the opening 208 and one or more of the conductors 292 of the flexible circuit 290' so that one of more of the conductors 292 are accessible when the base of the secondary circuit 200' is positioned over the end of the flexible circuit. FIG. 23 illustrates that the secondary circuit 200' includes a conductor 312 on a bottom surface thereof that is configured to align with and electrically connect to conductor 292' of the flexible circuit 290'.

Therefore, in use, a retailer may first position the flexible circuit 290' on the item of merchandise, such as by aligning the flexible circuit within a mounting plate 230 as discussed above, and attaching the flexible circuit such that an end of the flexible circuit is electrically connected to an internal power source 15. The flexible circuit 290' is attached such that the conductors 292, 292' face outwardly and are therefore exposed. The base of the secondary sensor 200' may then be positioned on the flexible circuit 290' such that the contact 312 aligns with contact 292'. When positioned, each of the contacts 292 of the flexible circuit 290' and contact 304 are facing outwardly and are therefore exposed. The contacts 292, 304 are configured to align with and electrically connect to respective conductors 294 on the sensor 214. Thus, an electrical connection may be established between the sensor 214, the flexible circuit 290', and the secondary sensor 200'. A sense loop may thereby be defined between the sensor 214, the flexible circuit 290', and the secondary sensor 200' via the conductive traces 206, 309. The sense loop in the secondary sensor 200' may be closed when the flexible component 94, 112, 202 is in contact with conductor 298. In some embodiments, the sense loop through the flexible circuit 290' and the secondary sensor 200' is only closed when the flexible component 94, 112, 202 is closed.

Figure 24:
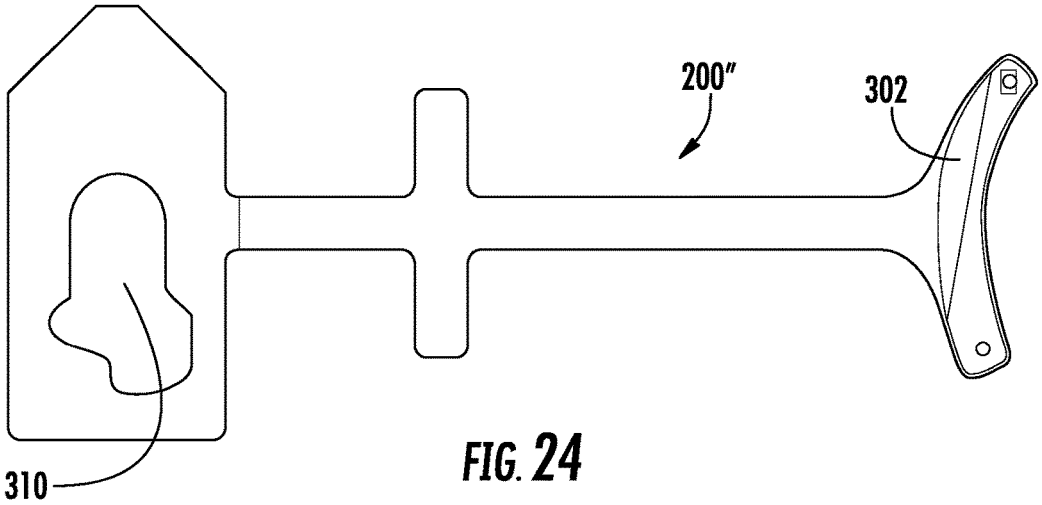
FIG. 24 is a plan view of a secondary sensor according to another embodiment of the present invention.
Figure 25:
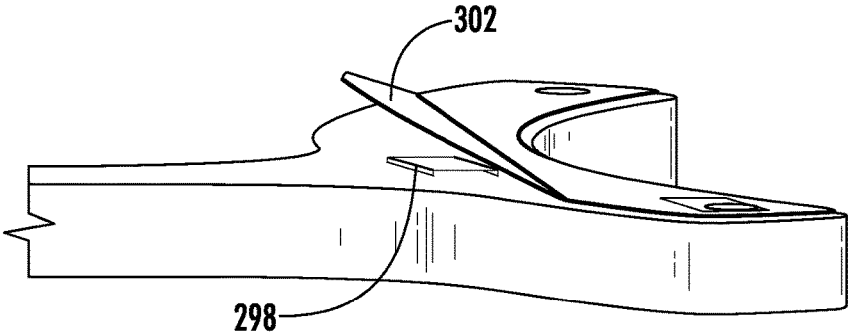
FIG. 25 is a partial perspective view of the secondary sensor shown in FIG. 24.
Figure 26:
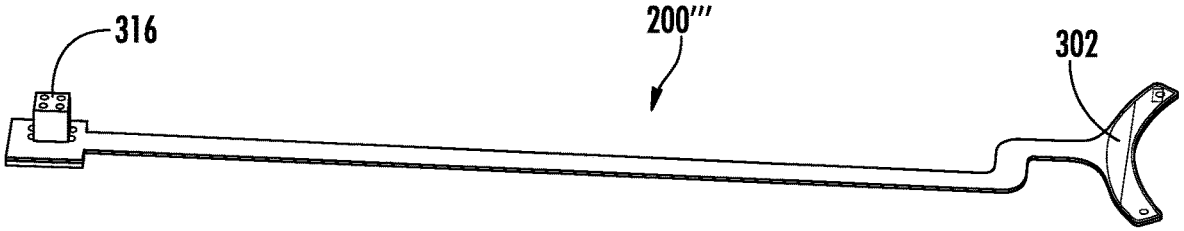
FIG. 26 is a perspective view of a secondary sensor according to another embodiment of the present invention.

FIGS. 24-26 illustrate additional embodiments of a secondary sensor 200", 200'". In the example shown in FIGS. 24-25, the secondary sensor 200" includes a flexible component 302. The flexible component 302 is configured to be biased into engagement with a conductor 298 as discussed above for forming a sense loop. The flexible component 302 may be secured to the secondary sensor 200" and include a pre-formed bend such that the flexible component extends away from the conductor 298. In this case, the flexible component 302 is anchored or otherwise secured at one or more locations. When a lens 13 is secured to the camera 12, the flexible component 302 is biased into contact with the conductor 298. Advantageously, the flexible component 302 is compressed perpendicularly to the conductor 298. Moreover, the flexible component 302 is configured such that rotation of the lens 13 relative to the camera 12 will not inadvertently catch or otherwise engage the flexible component, which reduces the incidence of damage to the flexible component as well as false alarms. Rather, rotation of the lens 13 onto the camera 12 compresses the flexible component 302 into engagement with the conductor 298. Similarly, rotation of the lens 13 off of the camera 12 allows the flexible component 302 to bias away from the camera. FIG. 26 shows a further embodiment of a secondary sensor 200'". In this embodiment, an end of the secondary sensor 200'" includes a connector 316, which may be used to engage a sensor, such as the sensor 104 described above in FIGS. 6-10.

It is understood that the illustrated embodiments of the flexible circuit 290' and secondary sensor 200', 200", 200'" are not intended to be limiting, as various configurations, sizes, and numbers of contacts and conductive traces may be employed. However, the illustrated embodiments demonstrate that the flexible circuit 290' and secondary sensor 200', 200", 200'" may be modular. In some instances, the secondary sensor 200', 200", 200'" may not be used as a sensor and in one example, may omit the portion extending outwardly from the base of the secondary sensor. Thus, the secondary sensor 200', 200", 200'" may be used to only complete the sense loop in the flexible sensor.

Figure 27:
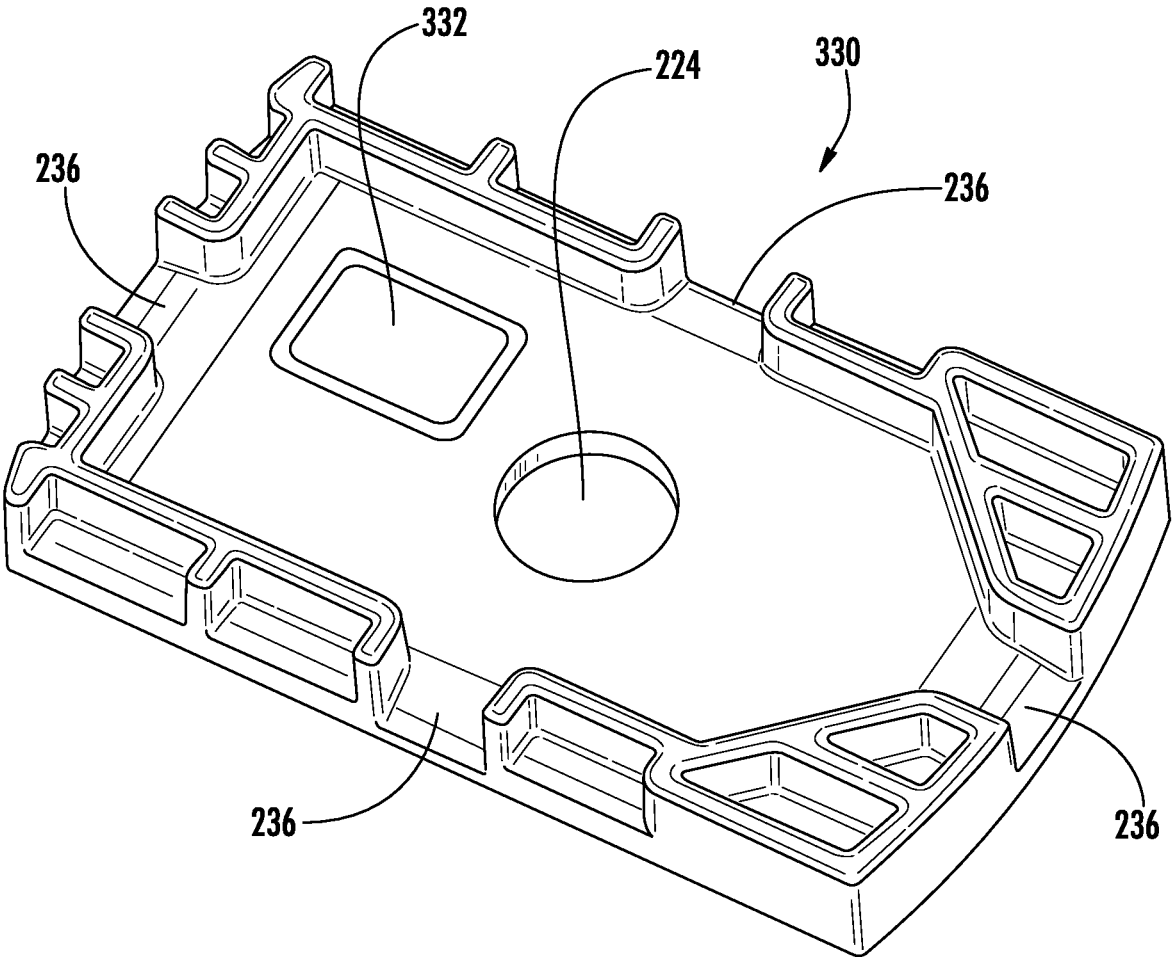
FIG. 27 is a perspective view of a mounting plate according to another embodiment of the present invention.

In other embodiments, only the secondary sensor 200', 200", 200'" may be used while the flexible circuit 290' is omitted. In this regard, FIG. 27 illustrates an embodiment of a mounting plate 330. In this embodiment, the mounting plate 330 may include a conductor 332 that is configured to align with and electrically connect to a conductor 312 on the secondary sensor 200', 200", 200'". Thus, the conductor 304 may be configured to align with and electrically connect to the resilient conductors 294 of the sensor 214 thereby creating an electrical connection between the secondary sensor 200', 200", 200'" and the sensor 214.

Although the illustrated embodiments have been shown in conjunction with a camera and a removable lens, it is understood that the flexible circuit and secondary sensor are applicable to any number of applications. Thus, the flexible circuit and secondary sensor may be useful for facilitating electrical communication with an internal battery source and/or protecting various removable components for portable electronic devices, such as lenses, batteries, battery covers, SIM cards, etc. In addition, it can be envisioned that the flexible circuit and secondary sensor may be used with a variety of portable electronic devices, including cameras.

Figure 28A:
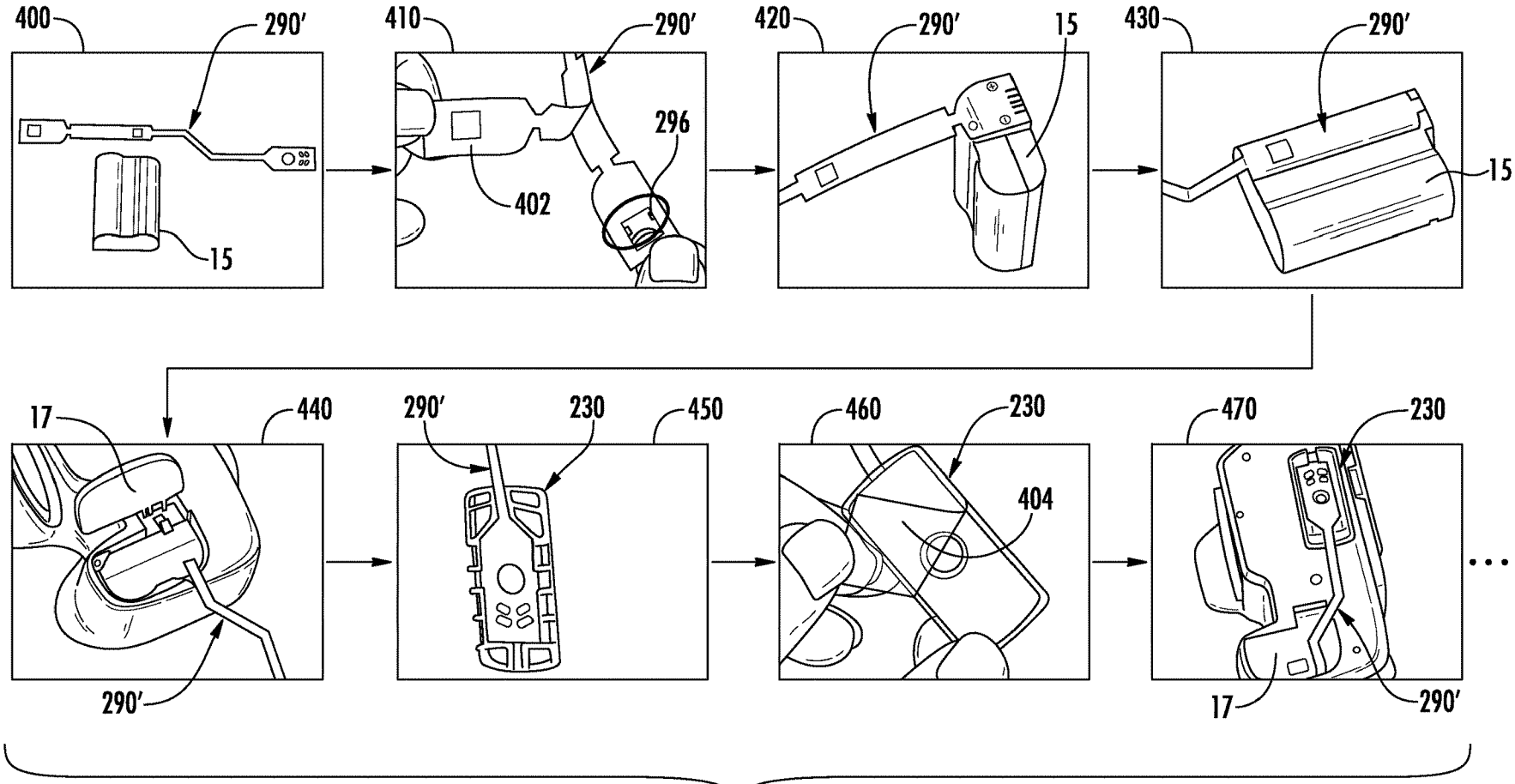
FIGS. 28A-28B illustrate a method of installing a merchandise security device according to one embodiment of the present invention.
Figure 28B:
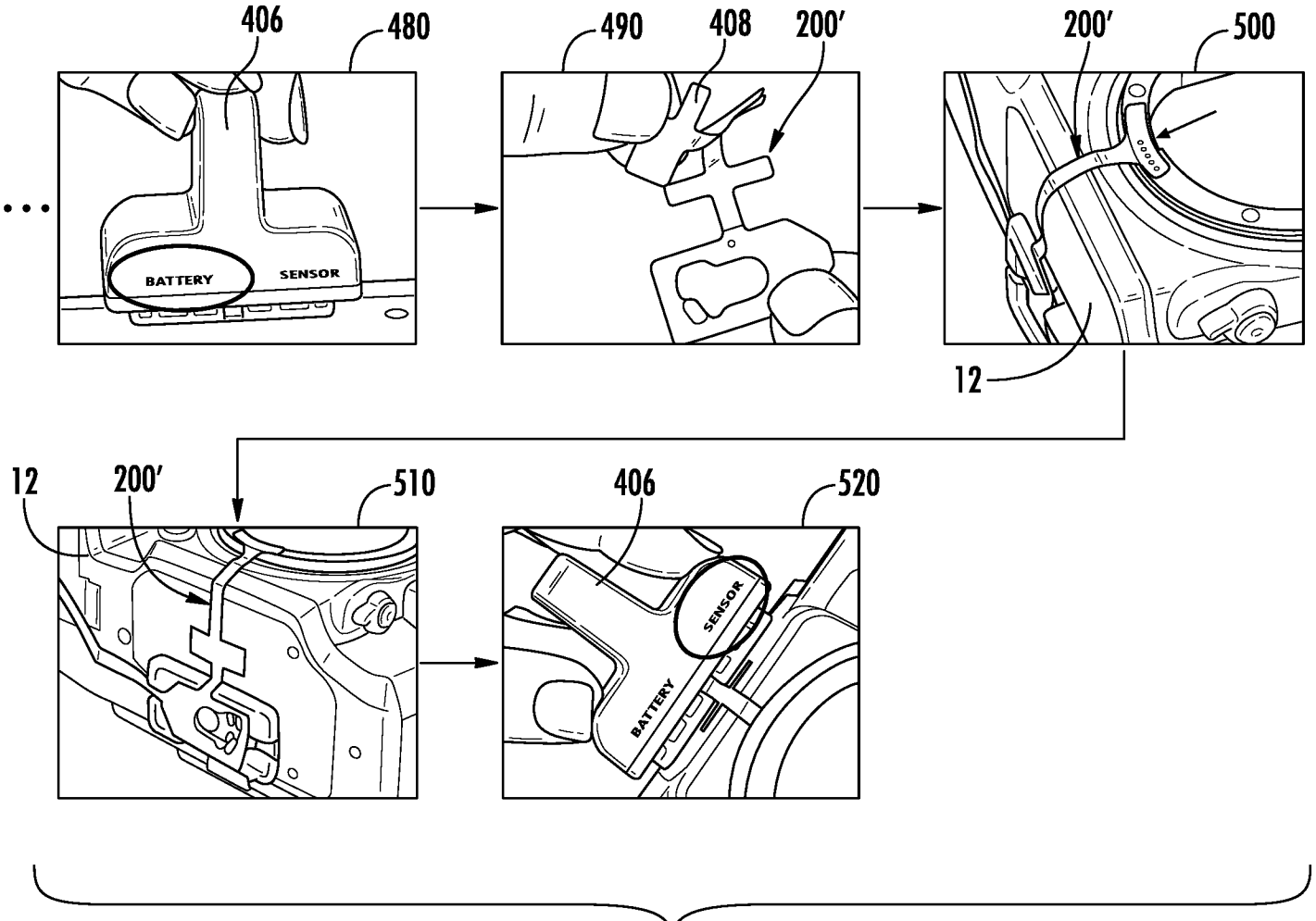

FIGS. 28A-28B illustrate one embodiment of a method for installing a merchandise display security device to a camera. Block 400 shows an internal power source 15 and a flexible circuit 290'. In block 410, a releasable backing 402 is removed from the flexible circuit 290', and in block 420, the conductors 296 are aligned with and secured to the terminals of the internal power source 15. In block 430, the flexible circuit 290' is adhered to the internal power source 15, and in block 440, the internal power source is inserted within a battery compartment of the camera 12. In block 450, the flexible circuit 290' is adhered to the mounting plate 230, and in block 460, a releasable backing 404 is removed from the mounting plate. In block 470, the mounting plate 230 and the remaining portion of the flexible circuit 290' are adhered to the camera 12, and the movable door 17 is closed. In block 480, a meter tool 406 may include resilient conductors similar to that of the sensor 214 and may be used to test the electrical connection with the internal power source 15. In block 490, a releasable backing 408 is removed from the secondary sensor 200', and in block 500, the secondary sensor is adhered to the portion of the flexible circuit 290' positioned within the mounting plate 230 and such that the flexible component 94, 112, 202, 302 is aligned with the lens 13. In block 510, the remaining portion of the secondary sensor 200' may be adhered to the camera 12, and in block 520, the meter tool 406 may be used to check the electrical connection between the secondary sensor 200', the flexible circuit 290', and the internal power source 15. The lens 13 may then be attached to the camera 12 so as to engage the flexible component 94, 112, 202, 302, and the sensor 214 may then be secured to the camera 12, such as with a fastener 24 engaging a tripod mount on the camera.

It is understood that the aforementioned method should not be construed to be limiting, as the steps may be performed in any desired sequence, and various steps may be added or omitted in other embodiments. For example, where a secondary sensor 200' is not used, the steps set forth in blocks 490, 500, 510, and 520 may be omitted. Similarly, where a flexible circuit 290' is omitted, the steps set forth in blocks 400, 410, 420, 430, 440, 450, 460, and 470 may be omitted.

The foregoing has shown and described one or more embodiments of a merchandise display security device. Many modifications and other embodiments of the invention will be readily apparent to one skilled in the art having the benefit of the teachings presented in the foregoing description and accompanying drawings. Therefore, it is to be understood that the invention is not limited to the embodiments shown and described herein and that variations of and modifications to the disclosed embodiments, as well as undisclosed embodiments within the ordinary skill of the art, are intended to be included within the content and scope of the appended claims.

That which is claimed is:

1. A merchandise display security device for protecting a portable electronic device having a removable component from theft, the portable electronic device having an attachment surface for attachment to the removable component, the merchandise display security device comprising:

a sensor configured to be secured to the portable electronic device;

a display stand configured to receive and support the sensor thereon, wherein the sensor and the removable component secured thereto are configured to be lifted from the display stand;

a cable configured to tether the sensor relative to the display stand;

monitoring electronics configured to detect unauthorized removal of the sensor from the portable electronic device; and the sensor comprising a flexible circuit configured to be positioned on the attachment surface and between the portable electronic device and the removable component when the removable component is attached to the portable electronic device such that the removable component overlies the flexible circuit, wherein the monitoring electronics is configured to detect unauthorized removal of the removable component from the portable electronic device with the flexible circuit.

2. The merchandise display security device of claim 1, wherein the portable electronic device comprises a camera and the removable component comprises a camera lens, and wherein the sensor comprises a fastener operable for engaging a tripod mount provided on the camera.

3. The merchandise display security device of claim 1, wherein the sensor further comprises a flexible component, and wherein the flexible component comprises an electrically conductive material configured to electrically connect to the flexible circuit.

4. The merchandise display security device of claim 3, wherein the flexible component comprises a pair of contacts extending away from one another in a relaxed state and configured to complete a sense loop when in contact with one another.

5. The merchandise display security device of claim 4, wherein the monitoring electronics is configured to detect when the pair of contacts have been biased from a position where the contacts are in contact with one another to a position in which the contacts are separated from one another.

6. The merchandise display security device of claim 1, wherein the sensor further comprises a flexible component, and wherein the flexible component is curved so as to be configured to conform to a curvature of the removable component.

7. The merchandise display security device of claim 1, wherein the sensor further comprises a flexible component configured to be electrically connected to the flexible circuit.

8. The merchandise display security device of claim 1, wherein the flexible circuit comprises a releasable adhesive for securing the flexible circuit to the portable electronic device.

9. The merchandise display security device of claim 1, further comprising a mounting plate configured to be attached to the portable electronic device, the mounting plate configured to receive and align the sensor relative to the portable electronic device.

10. The merchandise display security device of claim 1, further comprising a flexible power circuit configured to be in electrical communication with an internal power source of the portable electronic device and the sensor, the flexible power circuit configured to transfer power provided to the sensor to the internal power source.

11. The merchandise display security device of claim 10, wherein the flexible power circuit comprises means to determine a voltage level of the internal power source.

12. The merchandise display security device of claim 10, wherein the flexible sensor of the sensor is integrally formed with the flexible power circuit.

13. The merchandise display security device of claim 10, wherein the sensor and the flexible power circuit are modular and are configured to electrically connect to one another.

14. The merchandise display security device of claim 1, wherein the flexible circuit is configured to be positioned between and in direct contact with each of the removable component and the portable electronic device when the removable component is attached thereto.

15. The merchandise display security device of claim 7, wherein the monitoring electronics is configured to detect unauthorized removal of the removable component from the portable electronic device in response to movement of the flexible component.

16. A method for protecting a portable electronic device having a removable component from theft, the portable electronic device having an attachment surface for attachment to the removable component, the method comprising:

securing a sensor to a portable electronic device having a removable component such that the sensor is in electrical communication with monitoring electronics for detecting unauthorized removal of the sensor from the portable electronic device;

positioning a flexible circuit of the sensor on the attachment surface;

attaching the removable component to the portable electronic device such that the flexible circuit is positioned between the portable electronic device and the removable component and the removable component overlies the flexible circuit, the monitoring electronics being in electrical communication with the sensor for detecting unauthorized removal of the removable component from the portable electronic device with the flexible circuit; and positioning the sensor on a display stand, wherein the sensor and the removable component secured thereto are configured to be lifted from the display stand, a cable configured to tether the sensor relative to the display stand.

17. A merchandise display security device for protecting a portable electronic device having a removable component from theft, the portable electronic device having an attachment surface for attachment to the removable component, the merchandise display security device comprising:

a sensor configured to be secured to the portable electronic device;

a display stand configured to receive and support the sensor thereon, wherein the sensor and the removable component secured thereto are configured to be lifted from the display stand;

a cable configured to tether the sensor relative to the display stand;

monitoring electronics configured to detect unauthorized removal of the sensor from the portable electronic device; and a secondary sensor in electrical communication with the monitoring electronics, the secondary sensor comprising a flexible component configured to be positioned on the attachment surface and between the portable electronic device and the removable component when the removable component is attached to the portable electronic device such that the removable component overlies the flexible component, wherein the monitoring electronics is configured to detect unauthorized removal of the removable component from the portable electronic device with the flexible component.

18. The merchandise display security device of claim 17, wherein the secondary sensor comprises a cable electrically connected to the flexible component and the sensor.

19. The merchandise display security device of claim 18, wherein the cable comprises a plurality of conductors in electrical communication with the flexible component and the sensor.

20. The merchandise display security device of claim 17, further comprising a mounting plate configured to be attached to the portable electronic device, the mounting plate configured to receive and align the secondary sensor and the sensor relative to the portable electronic device.

* * * * *